US008418876B2

(12) United States Patent
Reay

(10) Patent No.: US 8,418,876 B2
(45) Date of Patent: Apr. 16, 2013

(54) VALVE ARRANGEMENT

(76) Inventor: Gavin Reay, London (GB)

( * ) Notice: Subject to any disclaimer, the term of this patent is extended or adjusted under 35 U.S.C. 154(b) by 583 days.

(21) Appl. No.: 12/530,935

(22) PCT Filed: Mar. 10, 2008

(86) PCT No.: PCT/GB2008/050168

§ 371 (c)(1),
(2), (4) Date: Dec. 11, 2009

(87) PCT Pub. No.: WO2008/110841

PCT Pub. Date: Sep. 18, 2008

(65) Prior Publication Data

US 2010/0108672 A1 May 6, 2010

(30) Foreign Application Priority Data

Mar. 10, 2007 (GB) ..... 0704679.0

(51) Int. Cl.
*B65D 51/16* (2006.01)
*A47G 19/22* (2006.01)

(52) U.S. Cl.
USPC ..... 220/714; 220/203.01; 220/203.11; 220/203.15; 220/203.16; 220/203.22; 220/703; 220/711; 220/713

(58) Field of Classification Search ..... 220/203.01, 220/203.03, 203.11, 203.15, 203.16, 203.22, 220/703, 711, 713, 714
See application file for complete search history.

(56) References Cited

U.S. PATENT DOCUMENTS

| | | | | |
|---|---|---|---|---|
| 6,732,882 | B2 * | 5/2004 | Belcastro | 220/714 |
| 2001/0035420 | A1 * | 11/2001 | Fusco et al. | 220/714 |
| 2004/0040962 | A1 * | 3/2004 | Bielecki et al. | 220/254.1 |
| 2005/0056653 | A1 * | 3/2005 | Miller | 220/710.5 |
| 2006/0289547 | A1 * | 12/2006 | Ewing et al. | 220/592.2 |

* cited by examiner

*Primary Examiner* — Anthony Stashick
*Assistant Examiner* — Madison L Poos
(74) *Attorney, Agent, or Firm* — Eugene M. Cummings, P.C.

(57) ABSTRACT

The present invention provides a valve arrangement for location on a vessel for holding liquids, comprising: a supporting member configured to form a valve seat; a deformable sealing member located against said valve seat and arranged for deformation under an applied pressure to present a first gap between said sealing member and said valve seat in a region where pressure is applied to allow a liquid to be dispensed from the vessel via said valve arrangement, and a second gap between said sealing member and a valve seat in a region where pressure is applied, to allow air to enter said valve arrangement.

33 Claims, 15 Drawing Sheets

VALVE ARRANGEMENT

The present invention relates to a valve arrangement, more particularly to a differential pressure valve arrangement, and most particularly to a differential pressure valve arrangement for a drink container.

Valves are known for their use in the regulation of the flow of fluids, and there are many configurations of valve available which achieve this effect.

A particular example of a known valve relates to a valve in a bicycle pump where leather disks are employed as a cylindrical seal that is operable to open under one set of differential pressures and close under an opposite set of differential pressures.

Non-spill drink containers, which are particularly suitable for small children, can comprise a closed container which is provided with a valve to allow a child to consume drink from the container. The valve is operable by a sucking action of the child to dispense a drink, but also serves to prevent spillage of the drink if the container is upturned.

Of course, it will be appreciated that when a closed container of this type is drained of its contents, it is necessary to replace the fluid flowing out of the container with another fluid in order to prevent a vacuum from being created within the container. In the case of a closed drink container, as the drink is emptied from the container, the void generated is replaced with air. Thus, in a closed drink container with a valve to control liquid-flow out of the container, the presence of a valve to control air-flow into the container is desirable to prevent the creation of a vacuum within the container. These valves may either be separate elements, or can comprise a common element.

A further consideration in the design of a non-spill drink container, particularly a valve thereof, is that the valve must provide a sufficient seal to retain liquid within the container if the container is upturned, or generally prevent spillage, but must also be weak enough such that its liquid retaining properties are overcome to allow it to be opened to dispense fluid under the action of the user, e.g. by a sucking action of the user's mouth. Thus, both an outlet valve for the container contents and an inlet valve for the air (which may be the same, or separate, elements) desirably open over a narrow range of operating pressures.

UK Patent No. GB 2,401,857 discloses a non-spill drinking vessel in which a container includes a lid having cylindrical inner and outer members, with the inner and outer members together defining an upstanding lip around the periphery of the lid, wherein the arrangement of the inner and outer members is such that an annular aperture is formed between the inner and outer members. A sealing element is located to cover the aperture, and is deformable by suction of a user so as to allow drink to be drawn from the container and to allow air to enter the container. The sealing element is deformed by suction in the region of the user's lips, and it is through this deformed region where the drink passes to the user. The sealing element also becomes deformed by suction at a point diametrically opposite the user's lips, and it is through this second deformed region where air passes into the container.

The valve arrangement of the above patent however exhibits limitations both in construction and operation and, as admitted, can allow a liquid to leak from the container.

The present invention seeks to provide for a valve arrangement having advantages over known such valve arrangements.

According to an aspect of the present invention, there is provided a valve arrangement for location on a vessel for holding liquids, comprising: a supporting member configured to form a valve seat; a deformable sealing member located against said valve seat and arranged for deformation under an applied pressure to present a first gap between said sealing member and said valve seat in a region where pressure is applied to allow a liquid to be dispensed from the vessel via said valve arrangement, and a second gap between said sealing member and a valve seat in a region where pressure is applied, to allow air to enter said valve arrangement.

An advantage of the present invention is that, the application of pressure, i.e. via a user's lips when drinking from said valve arrangement, operates the valve arrangement not only to dispense liquid, but also to allow air to pass through the valve arrangement, and into a container to which the valve arrangement is attached to equalise pressure in the container with atmospheric pressure. The applied pressure opens at least one gap in the region of the application of pressure between the sealing member and the supporting member of the valve arrangement to allow flow of liquid in one direction and air in the other direction.

Thus, the present invention provides a valve arrangement which is an effective seal.

The valve arrangement may further comprise a retaining member arranged to retain said deformable sealing member against said supporting member to a sufficient extent such that said deformable sealing member is held relative to said supporting member, but is free to deform to allow said first and second gaps to be presented when said deformable sealing member is deformed.

Preferably, said supporting member, deformable sealing member and retaining member define therebetween a chamber, with said chamber being arranged for fluid communication with a vessel to which said valve arrangement is attached by at least one first aperture formed in said retaining member.

Conveniently, said at least one first aperture comprises an outlet aperture arranged to allow flow of liquid from said vessel to which said valve arrangement is attached to said chamber.

If required, said retaining member may be formed with at least one second aperture therein to provide fluid communication between a vessel to which said valve arrangement is attached and an exterior of said valve arrangement, said at least one second aperture being covered by said sealing member when in an undeformed state, and said at least one second aperture being revealed when said second gap between said sealing member and said valve seat is formed.

Also, said at least one second aperture may comprise an inlet aperture arranged to allow flow of air from said exterior to said vessel to which said valve arrangement is attached.

Preferably, said supporting member defines an upstanding spout.

Conveniently, said valve arrangement comprises a linear arrangement and said sealing member comprises a planar sheet.

Alternatively, said valve arrangement may comprise a cylindrical arrangement and said sealing member comprises an annular member.

In a further alternative, said valve arrangement may comprise a cylindrical arrangement and said sealing member comprises a disc.

If required, said supporting member comprises means for attaching said valve arrangement to a vessel.

Preferably, the valve arrangement may further comprise an element for preventing said valve arrangement being inserted too far into a vessel.

Conveniently, the valve arrangement may further comprise a member for allowing a user to more conveniently grip said valve arrangement for removal of said valve arrangement from a vessel to which it is attached. Also, said valve arrangement may be provided with a light unit operable to emit light when an ambient light level falls below a predetermined level.

In particular said valve arrangement may further comprise a solar panel with a surface thereof arranged to be upfacing in a normal orientation of said valve arrangement, said solar panel being coupled to a rechargeable power source located within said light unit for providing power to said light unit, and said solar panel being arranged to recharge said rechargeable power source.

Preferably, the valve arrangement may further comprise a filling valve located in said sealing member and arranged to provide fluid communication with said second chamber to allow a user to add liquid to said second chamber in a first direction during a filling operation but to prevent liquid passing in a second opposite direction.

Conveniently, said filling valve may comprise a pressure deformable valve arranged to deform to reveal filling apertures providing fluid communication with said second chamber when a liquid is poured into said filling valve during a filling operation.

Also, the valve arrangement may further comprise a locking mechanism movable between a first position in which said locking mechanism serves to prevent deformation of said deformable sealing member, and a second position which allows said deformable sealing member to be deformed under application of pressure.

According to another aspect of the present invention, there is provided a valve arrangement for location on a vessel for holding liquids, comprising: a supporting member configured to form a valve seat; a deformable sealing member located against said valve seat and arranged for deformation under an applied pressure to present a gap between said sealing member and said valve seat in a region where pressure is applied to allow a liquid to be dispensed from the vessel via said valve arrangement; and an air inlet element arranged to allow air to enter said valve arrangement.

Preferably, the valve arrangement may further comprise a retaining member arranged to retain said deformable sealing member against said supporting member to a sufficient extent such that said deformable sealing member is held relative to said supporting member, but is free to deform to allow said gap to be presented when said deformable sealing member is deformed.

Conveniently, said retaining member may be integral with said deformable sealing member.

If required, said air inlet element may be located in said deformable sealing member.

In particular, said air inlet element member may comprise at least one aperture.

Preferably, a one-way valve arranged to allow flow of air therethrough in a first direction and prevent flow of liquid therethrough in a second, opposite direction, may be located in said at least one aperture.

Further, a breathing membrane arranged to allow flow of air therethrough in a first direction and prevent flow of liquid therethrough in a second, opposite direction, therethrough may be located in said at least one aperture.

Also, said air inlet element may comprise at least a portion of said sealing member formed from a breathing membrane, said breathing membrane arranged to allow flow of air therethrough in a first direction and prevent flow of liquid therethrough in a second, opposite direction.

Preferably, said supporting member defines an upstanding spout.

Conveniently, said valve arrangement comprises a linear arrangement and said sealing member comprises a planar sheet.

Alternatively, said valve arrangement may comprise a cylindrical arrangement and said sealing member comprises an annular member.

In a further alternative, said valve arrangement may comprise a cylindrical arrangement and said sealing member comprises a disc.

If required, said supporting member comprises means for attaching said valve arrangement to a vessel.

Preferably, the valve arrangement may further comprise an element for preventing said valve arrangement being inserted too far into a vessel.

Conveniently, the valve arrangement may further comprise a member for allowing a user to more conveniently grip said valve arrangement for removal of said valve arrangement from a vessel to which it is attached.

Also, said valve arrangement may be provided with a light unit operable to emit light when an ambient light level falls below a predetermined level.

In particular said valve arrangement may further comprise a solar panel with a surface thereof arranged to be upfacing in a normal orientation of said valve arrangement, said solar panel being coupled to a rechargeable power source located within said light unit for providing power to said light unit, and said solar panel being arranged to recharge said rechargeable power source.

Preferably, the valve arrangement may further comprise a filling valve located in said sealing member and arranged to provide fluid communication with said second chamber to allow a user to add liquid to said second chamber in a first direction during a filling operation but to prevent liquid passing in a second opposite direction.

Conveniently, said filling valve may comprise a pressure deformable valve arranged to deform to reveal filling apertures providing fluid communication with said second chamber when a liquid is poured into said filling valve during a filling operation.

Also, the valve arrangement may further comprise a locking mechanism movable between a first position in which said locking mechanism serves to prevent deformation of said deformable sealing member, and a second position which allows said deformable sealing member to be deformed under application of pressure.

According to a further aspect of the present invention, there is provided a vessel for holding liquids comprising a liquid containing receptacle; and a valve arrangement as described above mounted on an open end of said receptacle.

The vessel may further comprise at least one air inlet aperture located in a wall and/or base of said receptacle, and/or at a rim of said receptacle, with a fluid control member located in said air inlet aperture.

Preferably, said fluid control member comprises a one-way valve arranged to allow flow of air into said receptacle and prevent flow of liquid out of said receptacle.

Conveniently, said fluid control member comprises a breathing membrane arranged to allow flow of air into said receptacle and prevent flow of liquid out of said receptacle.

If required, said valve arrangement may be attached to said receptacle by way of a push-fit sealing element.

Also, said valve arrangement may be integral with said receptacle.

The present invention further provides a differential pressure activated valve arrangement comprising a generally sealing member of a generally flexible material having generally flexible and sealing ledges that form valve seats on two surfaces of a supporting member, comprising a generally sealing member that is deformable, and a supporting member with perforations where the supporting member supports the flexible member and which provides contacting surfaces so as to define at least two apertures, there apertures being between one edge of the flexible member with the inner surface of the supporting member and of one edge of the flexible member with the inner surface of the supporting member.

Preferably, the sealing member is adapted to deform so as to open two or more apertures when subjected to a differential pressure.

Conveniently, a negative or positive pressure applied to an aperture results in a pressure differential which causes a flexing of the sealing member resulting in a lifting of the sealing ledge which in turn causes a reduced pressure on the inside of a retaining vessel, the reduced pressure of which causes a further deformation of the sealing member which causes a second sealing edge of the sealing member to flex and lift from a second sealing surface.

Preferably, a pressure differential can be applied by suction at an aperture from, but not limited to, a mouth.

Conveniently, the tension of the sealing member providing a sealing surface at apertures is greater than the pressure of the contents within the supporting member but is less than the pressure applied by the external differential pressure.

Preferably, the supporting member can form a vessel such as, but not limited to, a drinking cup that can contain a substance such as a liquid, gas or solid.

Conveniently, the supporting member can form an attachment such as, but not limited to, a lid, spout or nipple to a vessel such as, but not limited to, a drinking cup that can contain a substance such as a liquid, gas or solid.

Preferably, the sealing member can form a vessel such as, but not limited to, a drinking cup that can contain a substance such as a liquid, gas or solid.

Conveniently, the sealing member can form an attachment such as, but not limited to, a lid, spout or nipple to a vessel such as, but not limited to, a drinking cup that can contain a substance such as a liquid, gas or solid.

Preferably, the supporting member and sealing member can form a closed perimeter so as to provide generally cylindrical apertures.

Conveniently, the supporting member and sealing member can form part of a perimeter so as to define locations for apertures.

The present invention is described further hereinafter, by way of example only, with reference to the accompanying drawings in which:

FIG. 1*a* illustrates a perspective view of a valve arrangement in a first embodiment of the present invention;

FIG. 1*b* illustrates an exploded perspective view in a first orientation of the valve arrangement of the first embodiment;

FIG. 1*c* illustrates an exploded perspective view in a second orientation of the valve arrangement of the first embodiment;

FIG. 2 illustrates a cross-sectional side view of the valve arrangement of the first embodiment;

FIG. 3*a* illustrates a cross-sectional side view of the valve arrangement of the first embodiment where the valve arrangement is tilted FIG. 3*b* illustrates a cross-sectional side view of the valve arrangement of the first embodiment where the valve arrangement is tilted and in use;

FIG. 4*a* illustrates a perspective view of a valve arrangement in a second embodiment of the present invention;

FIG. 4*b* illustrates a cross-sectional perspective view of the valve arrangement of the second embodiment;

FIG. 4*c* illustrates a cross-sectional side view of the valve arrangement of the second embodiment;

Figure 7A:
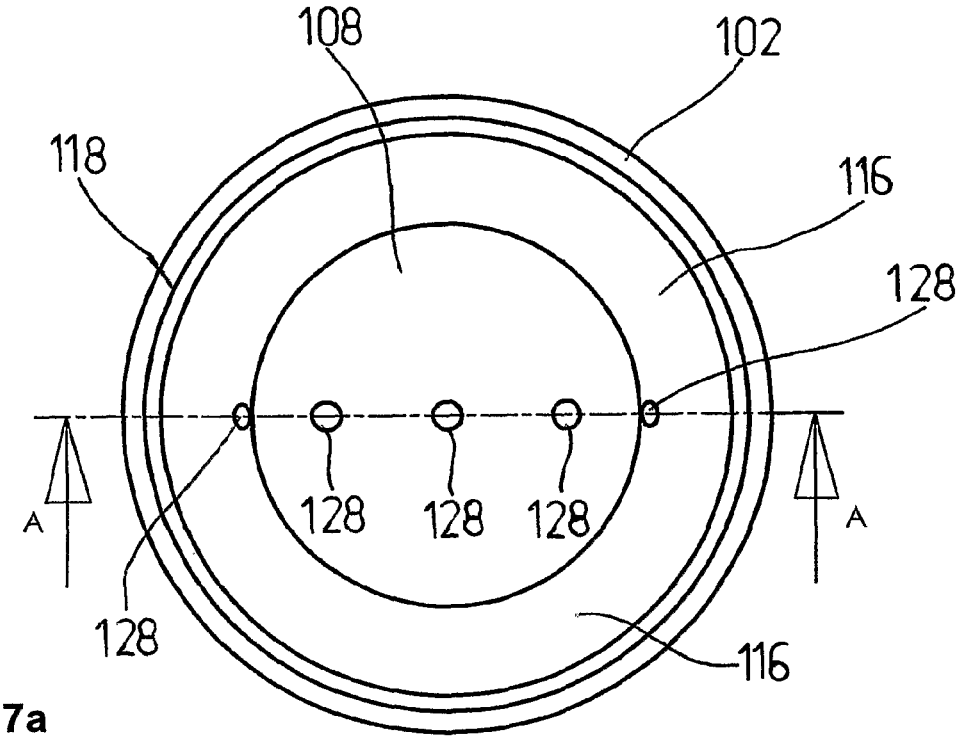
Figure 7B:
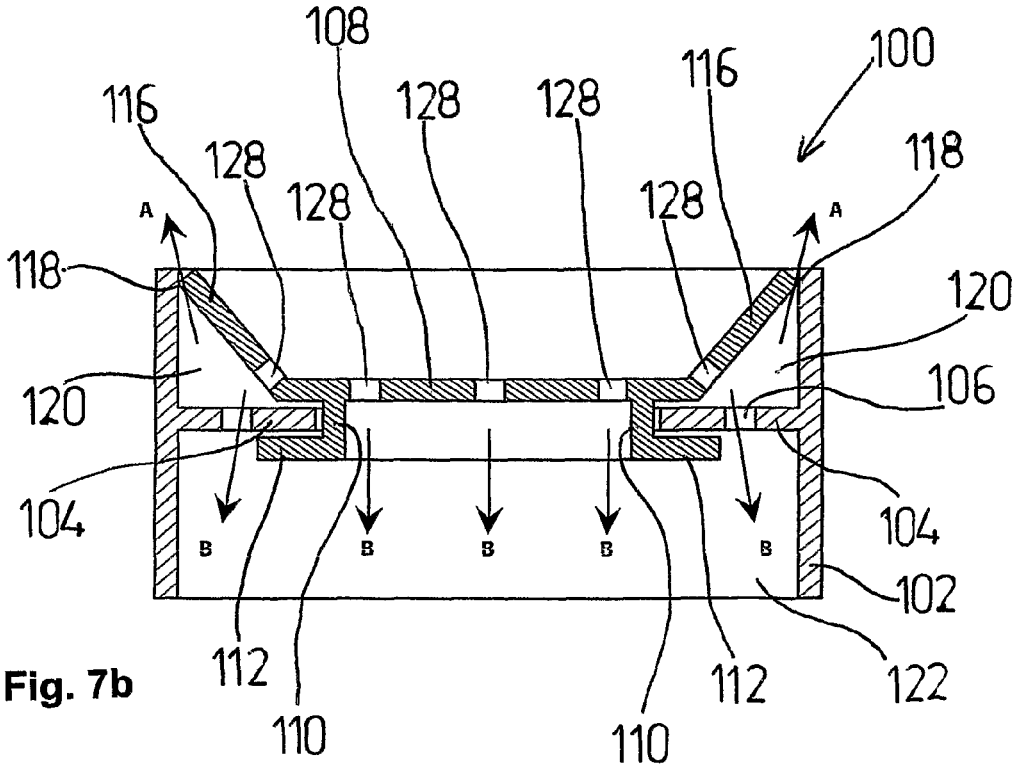
Figure 8:
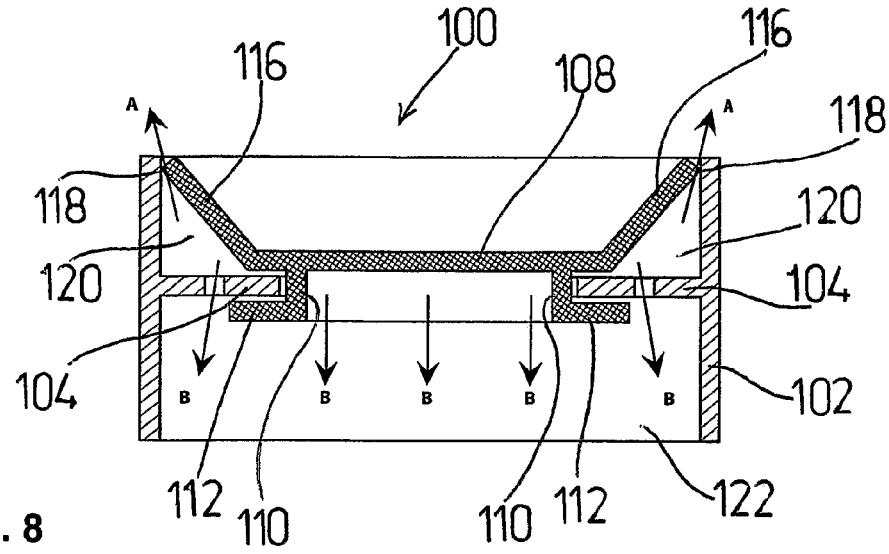
Figure 9:
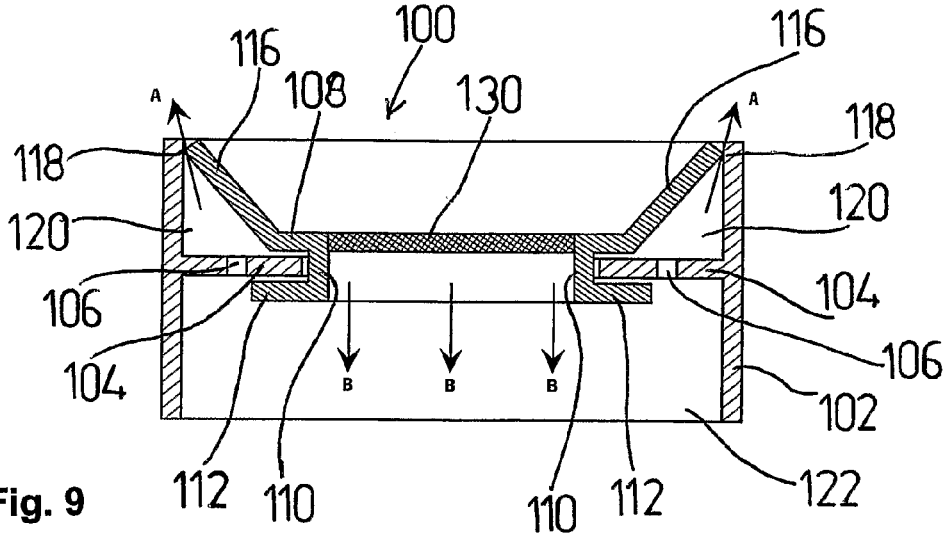
Figure 10:
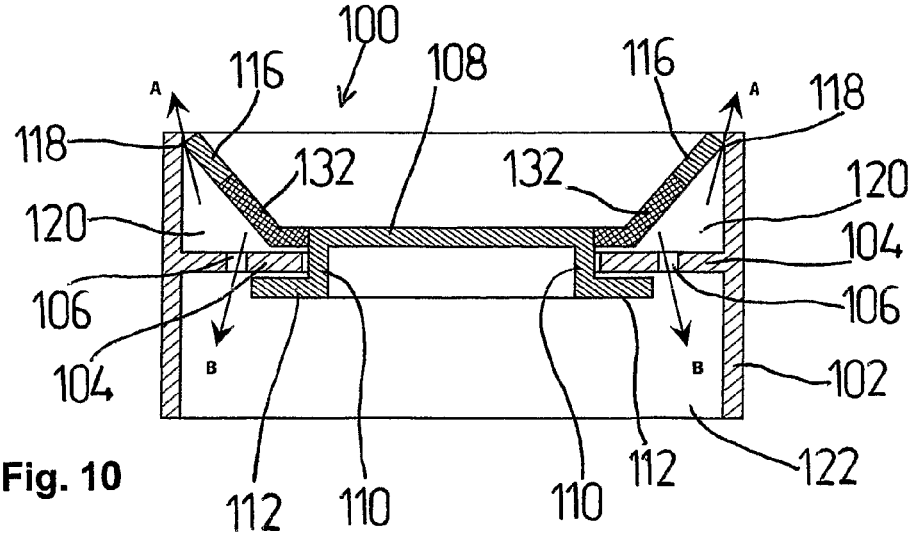
Figure 11:
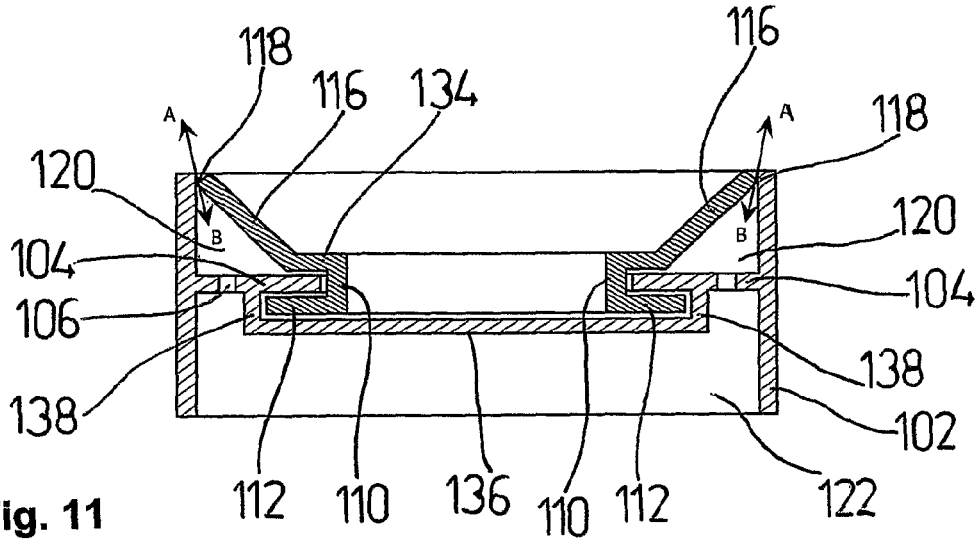
Figure 12:
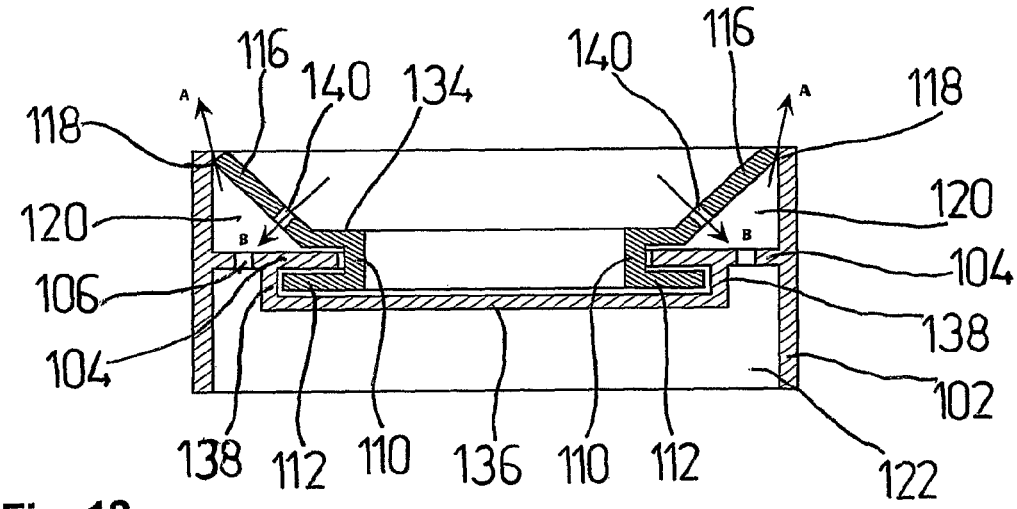
Figure 13:
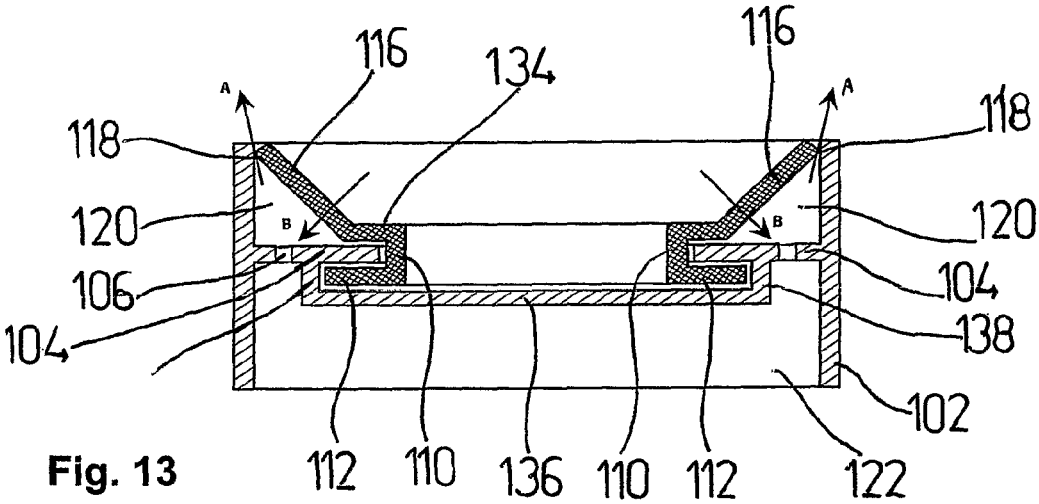
Figure 14:
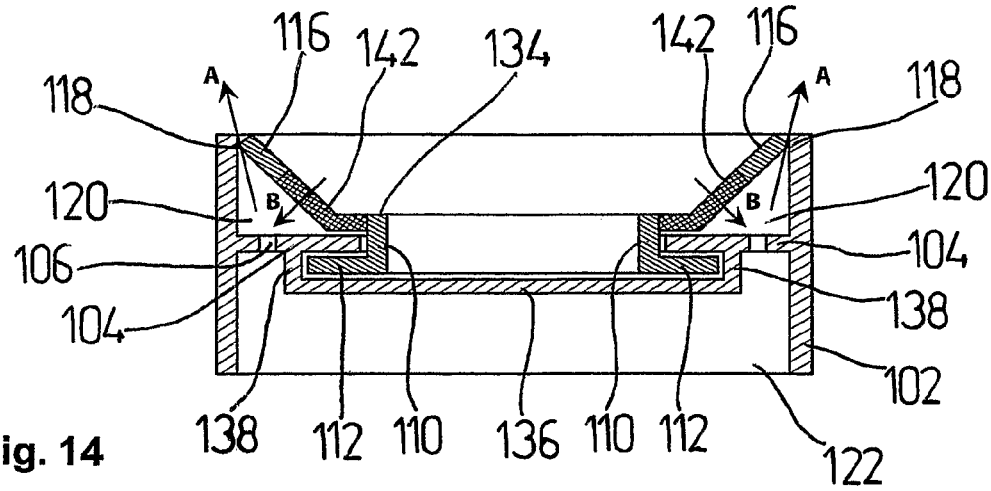
Figure 15:
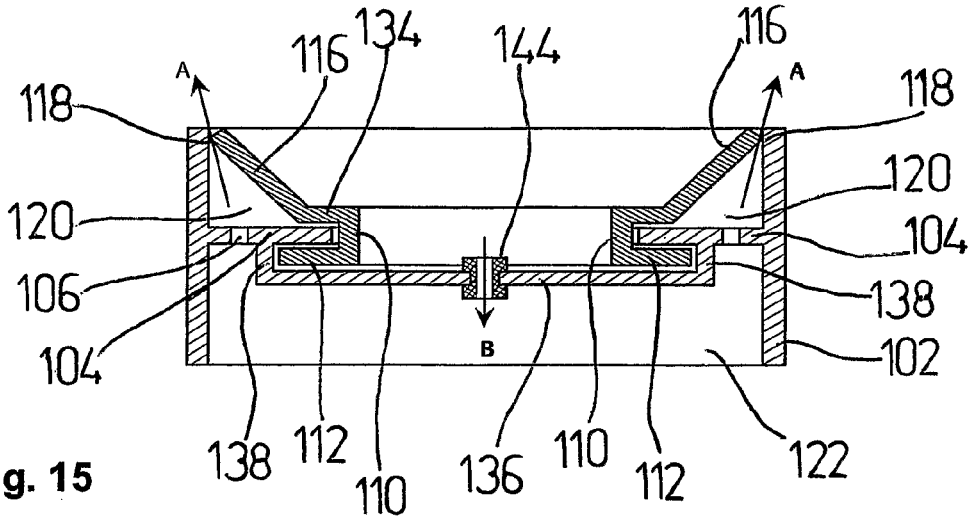
Figure 16:
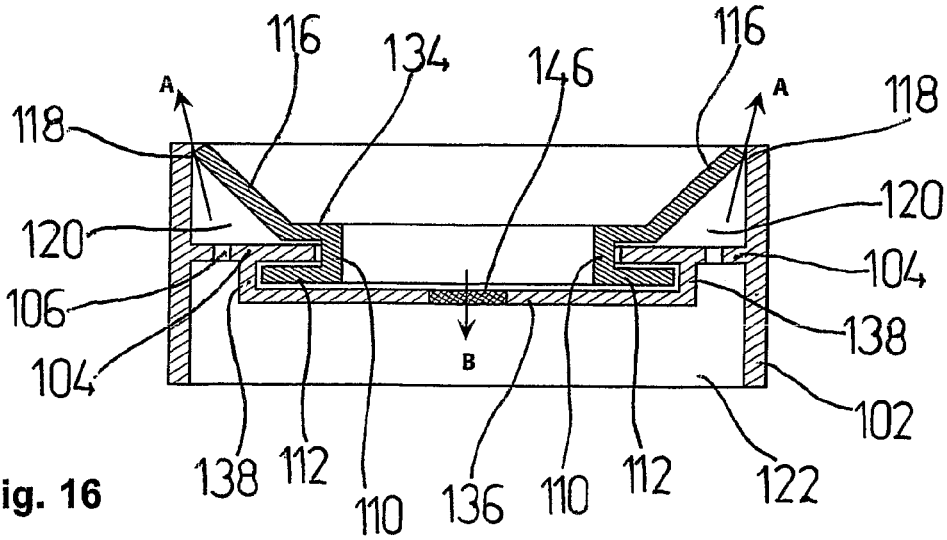
Figure 17:
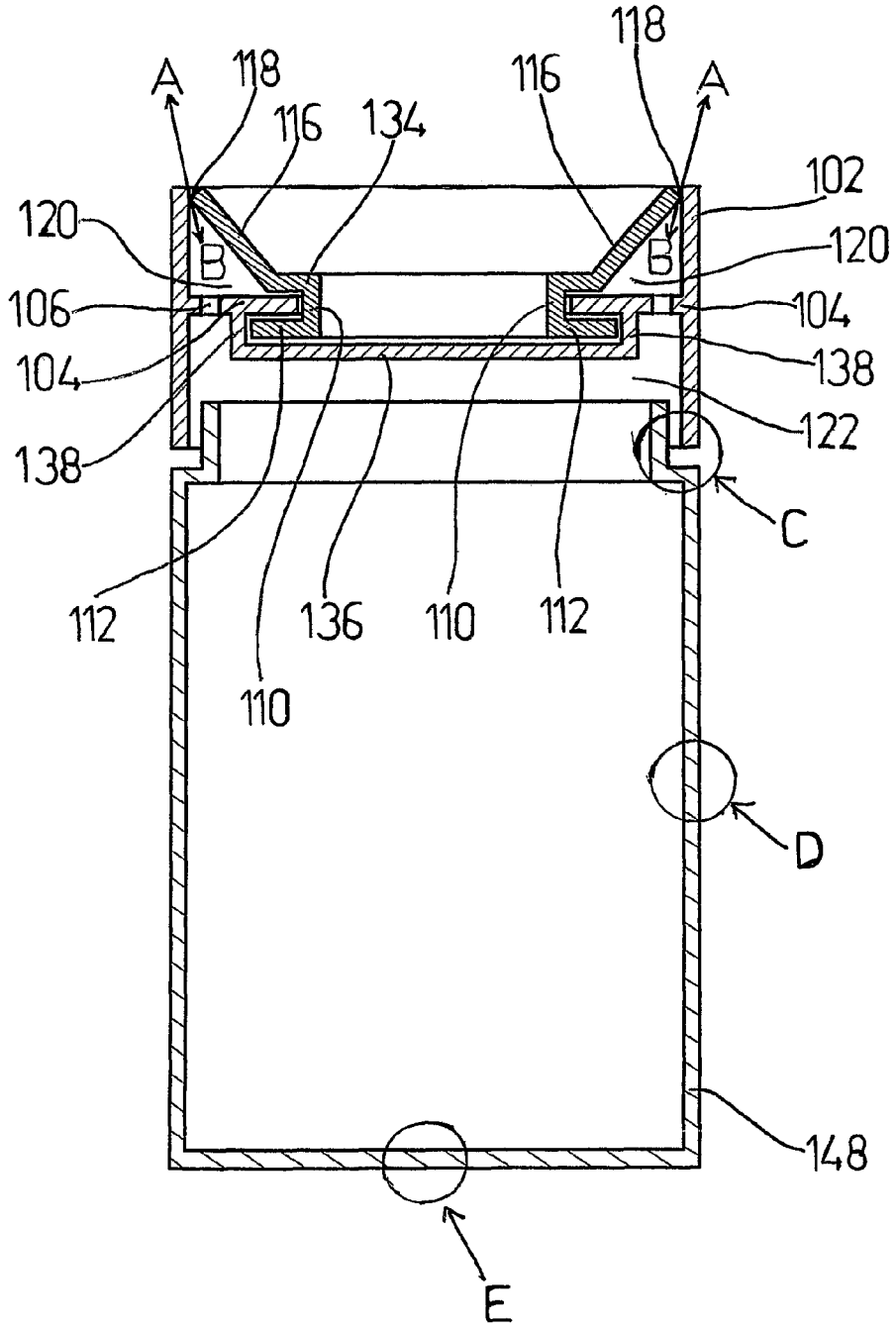
Figure 18:
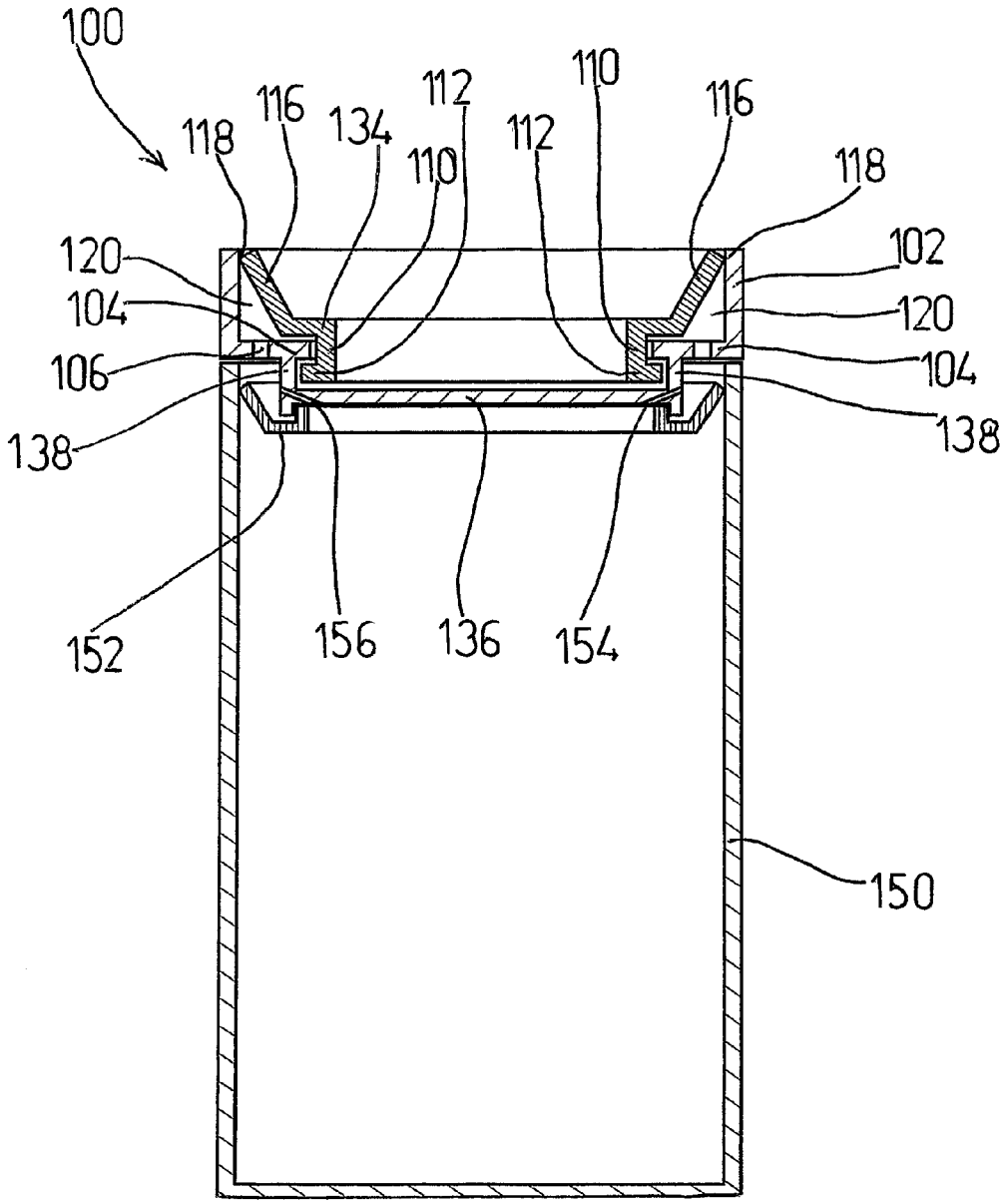
Figure 19:
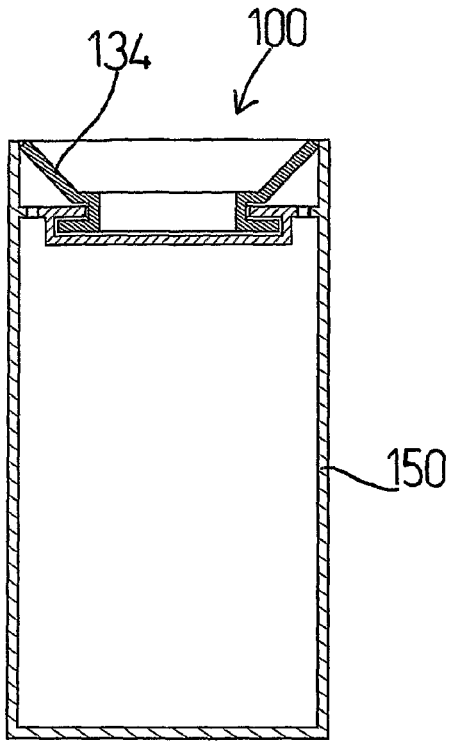
Figure 20:
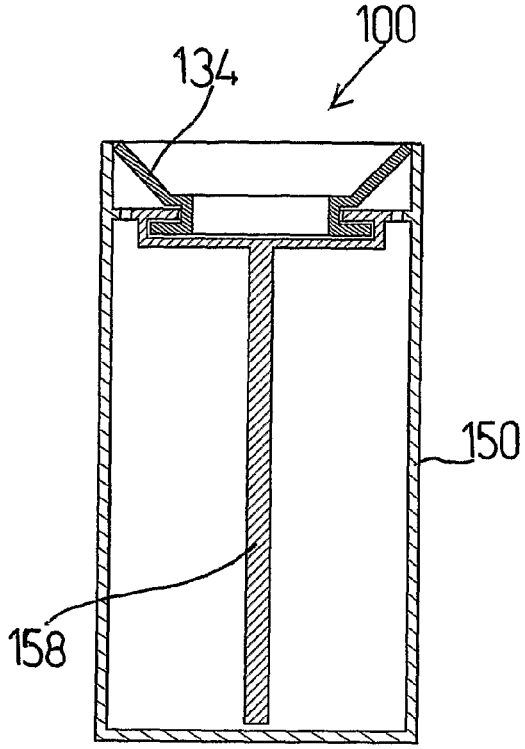
Figure 21:
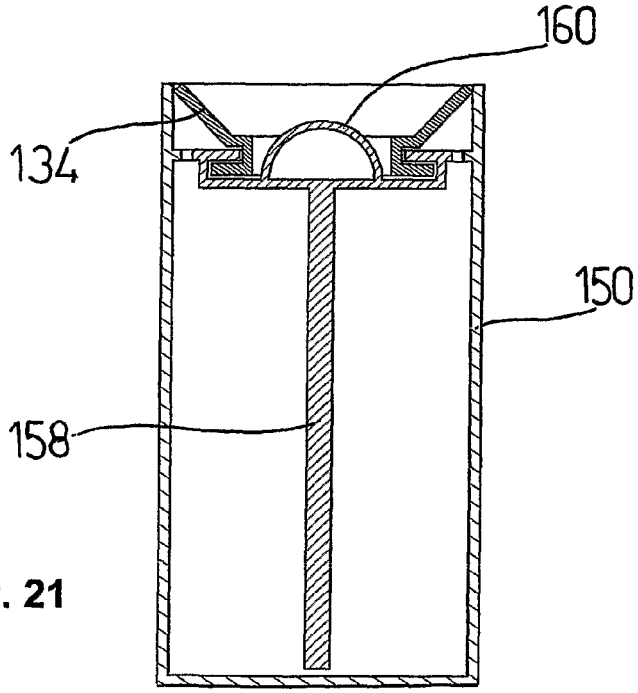
Figure 22:
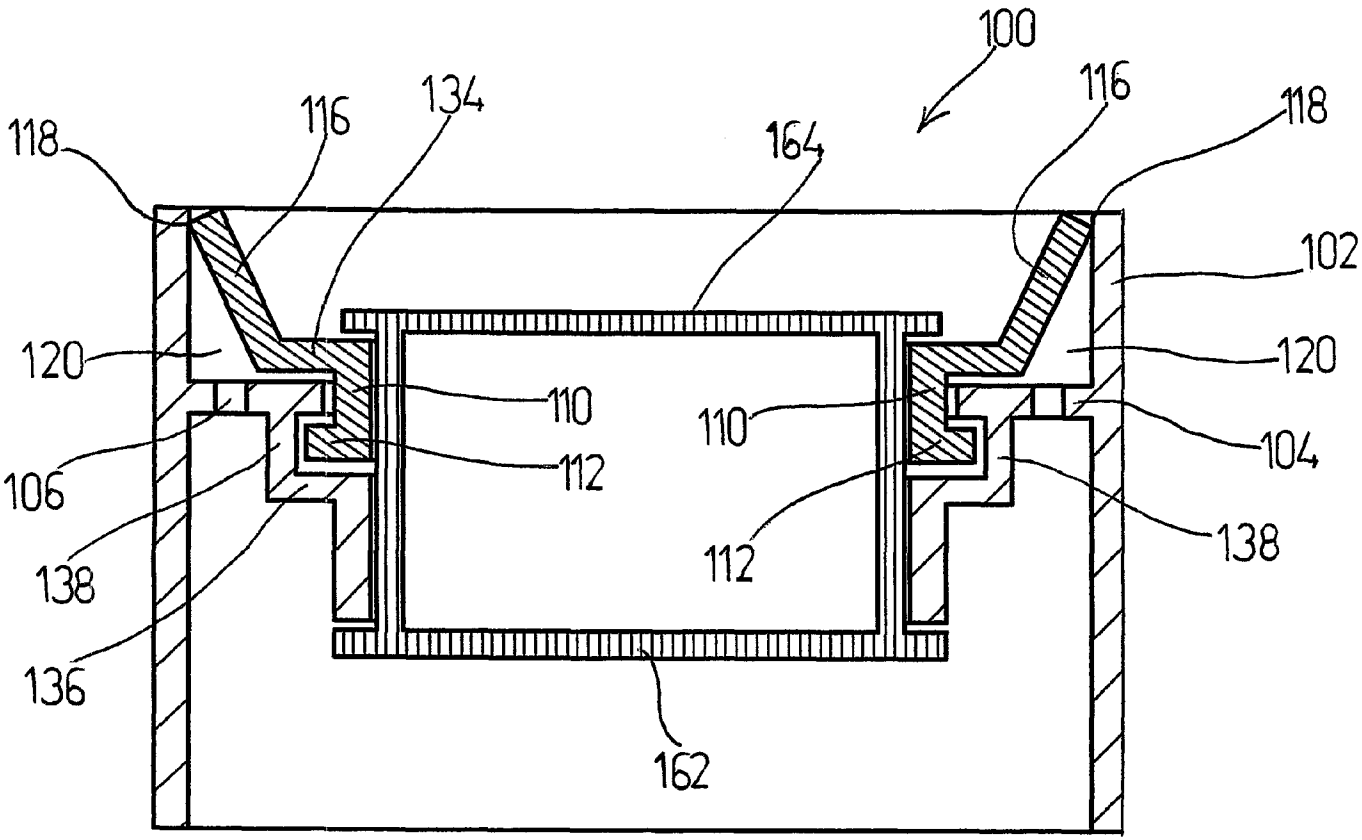
Figure 23A:
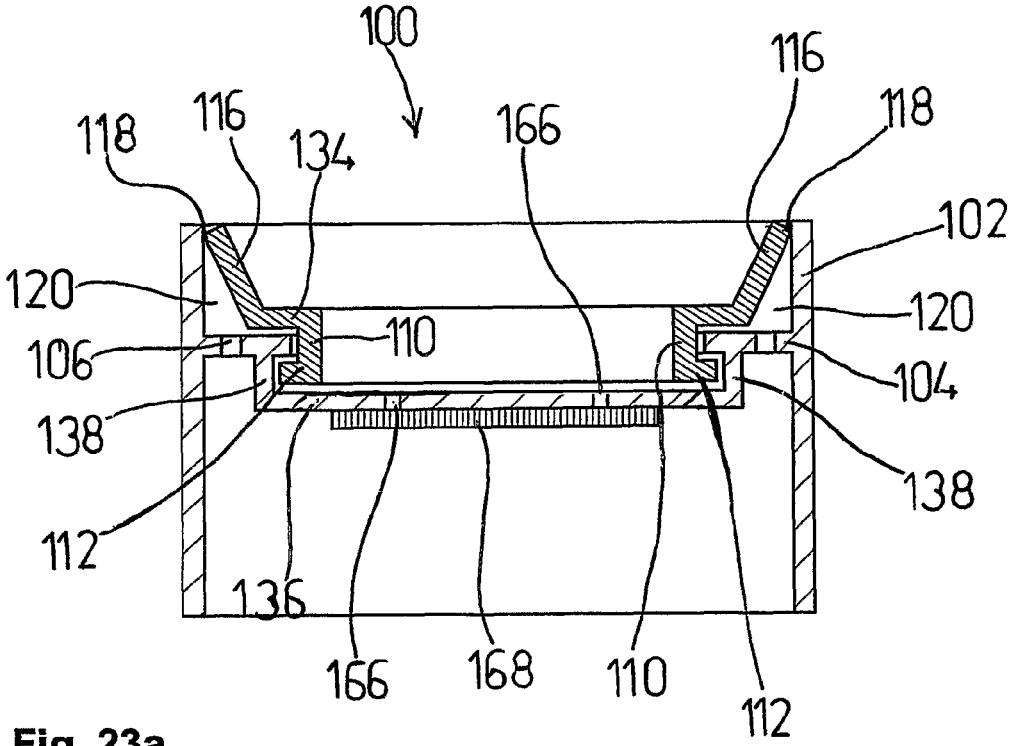
Figure 23B:
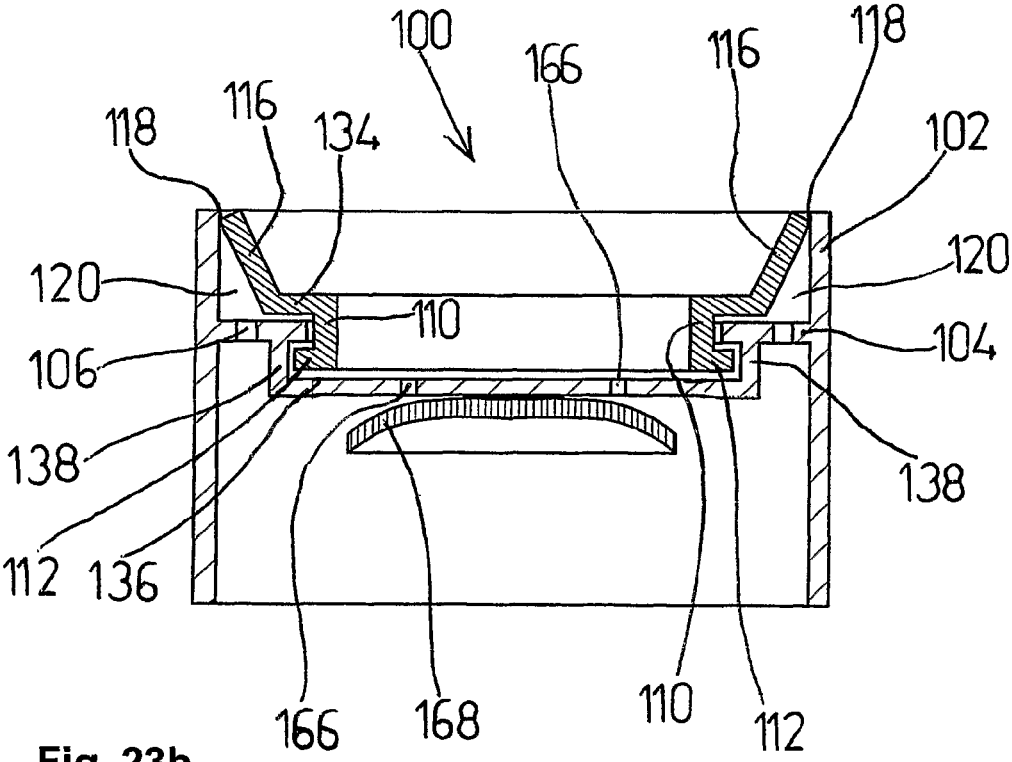
Figure 24A:
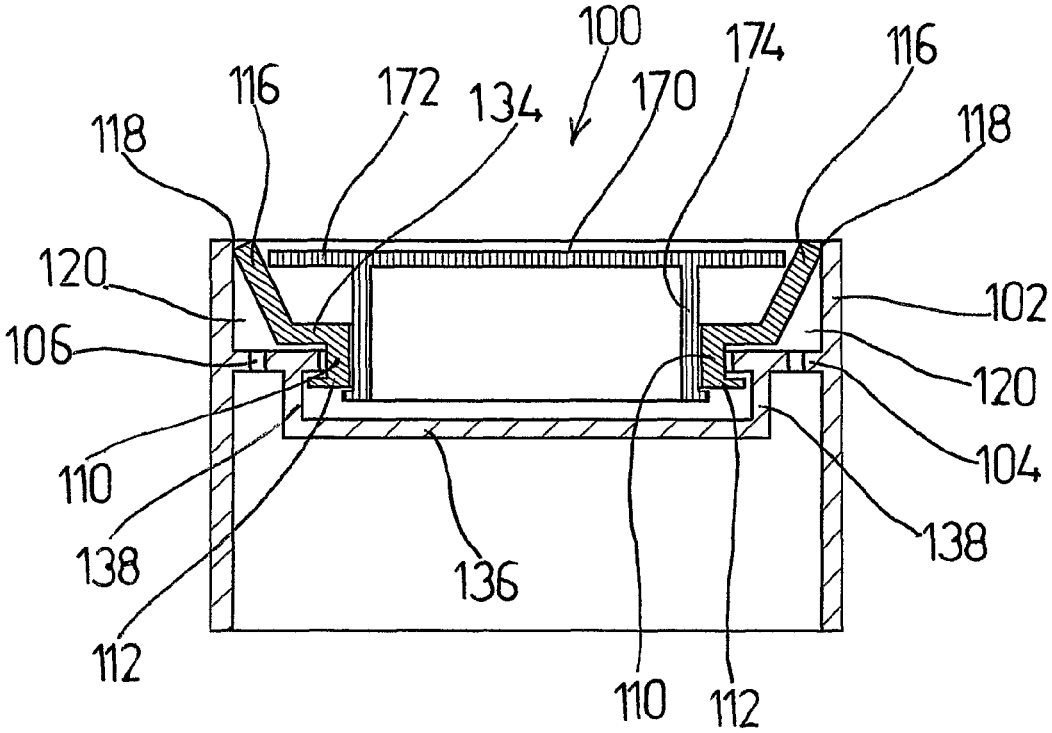
Figure 24B:
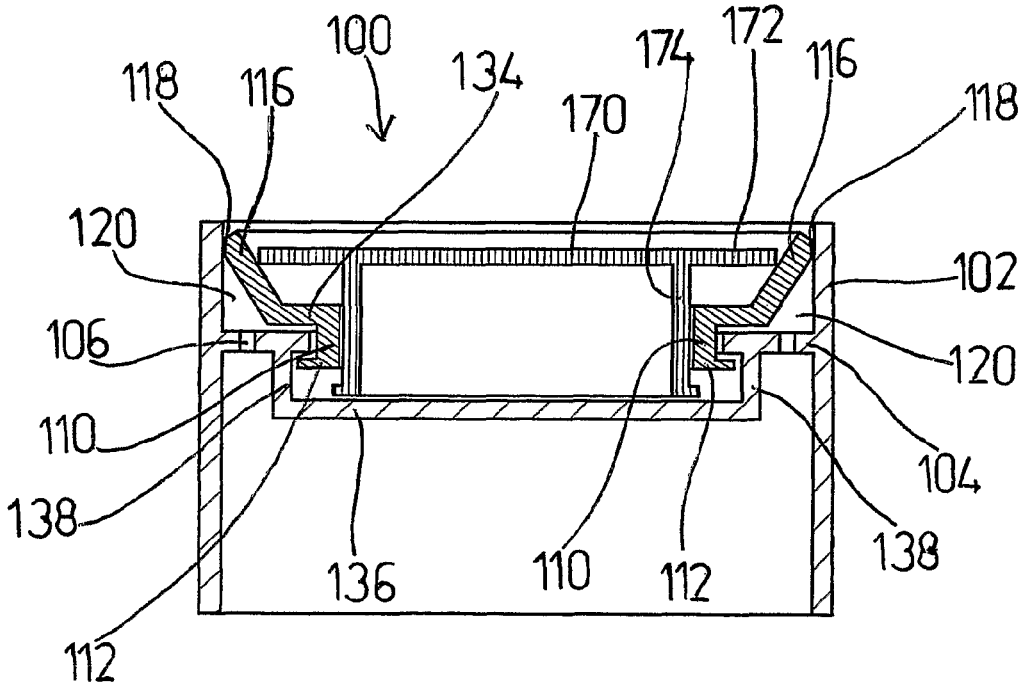

FIG. 7*a* illustrates a plan view of a valve arrangement in a fifth embodiment of the present invention;

FIG. 7*b* illustrates a cross-sectional side view of the valve arrangement of FIG. 7*a* along the line A-A;

FIG. 8 illustrates a cross-sectional side view of a valve arrangement in a sixth embodiment of the present invention;

FIG. 9 illustrates a cross-sectional side view of a valve arrangement in a seventh embodiment of the present invention;

FIG. 10 illustrates a cross-sectional side view of a valve arrangement in a eighth embodiment of the present invention;

FIG. 11 illustrates a cross-sectional side view of a valve arrangement in a ninth embodiment of the present invention;

FIG. 12 illustrates a cross-sectional side view of a valve arrangement in a tenth embodiment of the present invention;

FIG. 13 illustrates a cross-sectional side view of a valve arrangement in a eleventh embodiment of the present invention;

FIG. 14 illustrates a cross-sectional side view of a valve arrangement in a twelfth embodiment of the present invention;

FIG. 15 illustrates a cross-sectional side view of a valve arrangement in a thirteenth embodiment of the present invention;

FIG. 16 illustrates a cross-sectional side view of a valve arrangement in a fourteenth embodiment of the present invention;

FIG. 17 illustrates a cross-sectional side view of a valve arrangement in a fifteenth embodiment of the present invention;

FIG. 18 illustrates a cross-sectional side view of a valve arrangement in a sixteenth embodiment of the present invention;

FIG. 19 illustrates a cross-sectional side view of a valve arrangement in a seventeenth embodiment of the present invention;

FIG. 20 illustrates a cross-sectional side view of a valve arrangement in a eighteenth embodiment of the present invention;

FIG. 21 illustrates a cross-sectional side view of a valve arrangement in a nineteenth embodiment of the present invention;

FIG. 22 illustrates a cross-sectional side view of a valve arrangement in a twentieth embodiment of the present invention;

FIG. 23*a* illustrates a cross-sectional side view of a valve arrangement in a twenty-first embodiment of the present invention;

FIG. 23*b* illustrates a cross-sectional side view of the valve arrangement of FIG. 23*a* during a filling process;

FIG. 24*a* illustrates a cross-sectional side view of a valve arrangement in a twenty-second embodiment of the present invention; and FIG. 24*b* illustrates a cross-sectional side view of the valve arrangement of FIG. 24*a* in a locked position.

Figure 1A:
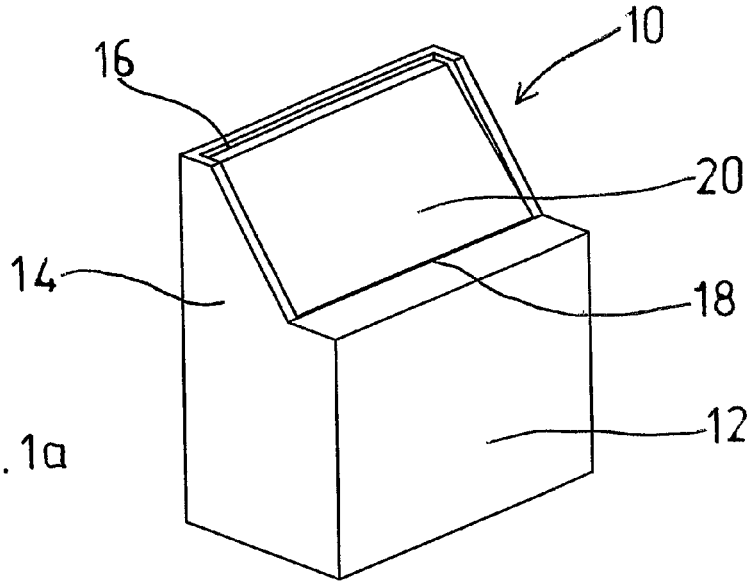

As mentioned, FIG. 1*a* illustrates a valve arrangement 10 on a container 12 suitable for holding a liquid, such as a drink. An upstanding spout region forms a supporting member 14, surfaces of which are formed as first and second valve seats 16, 18 and a substantially planar sealing member 20 is located across an open portion (not shown) of said supporting member 14. The sealing member 20 is formed from a deformable material such as, for example, silicone. Parallel edges of said sealing member 20 are arranged for location against said first and second valve seats 16, 18 and the sealing member 20 is retained in position across said open portion of the supporting member 14.

The container 12 comprises two chambers: a first chamber (not shown) formed by the spout and sealing member 20; and a second chamber (not shown) located below the first chamber and formed within a main body of the container 12. The first chamber is separated from the second chamber by a partition (not shown) which defines the boundary between the container 12 and the spout region. Apertures (not shown) in said partition provide paths of fluid communication between the first and second chambers, and also between said second chamber and an exterior of the container 12.

Figure 1B:
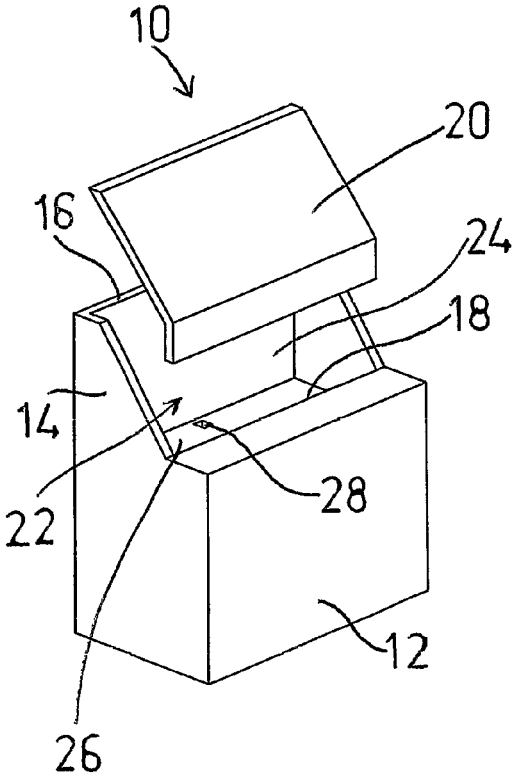

In FIG. 1*b*, the sealing member 20 is located above and spaced from the supporting member 14 to allow convenient viewing of the open portion 22, first chamber 24 and partition 26. A first aperture 28 is formed in said partition 26 and provides fluid communication between the first chamber 24 and second chamber (not shown).

Figure 1C:
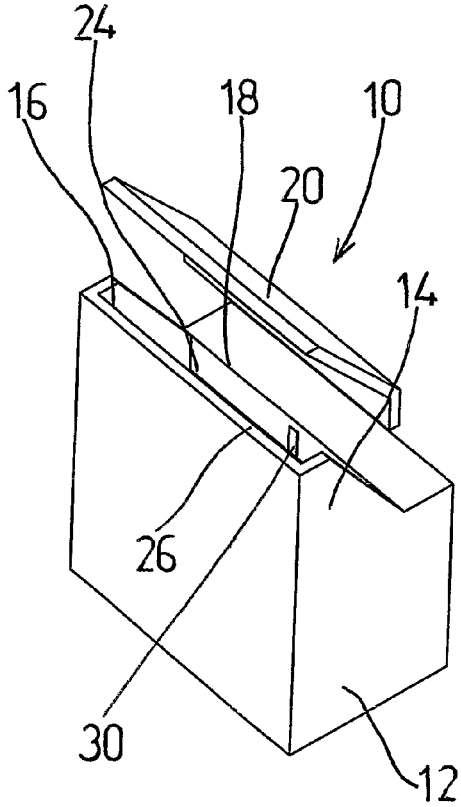

FIG. 1*c* is similar to FIG. 1*b*, but illustrates the valve arrangement 10 from the reverse angle. In this figure, a second aperture 30 formed in said partition 26 is illustrated, and it will be appreciated that second valve seat 18 is formed from an upstanding portion of the partition 26.

Figure 2:
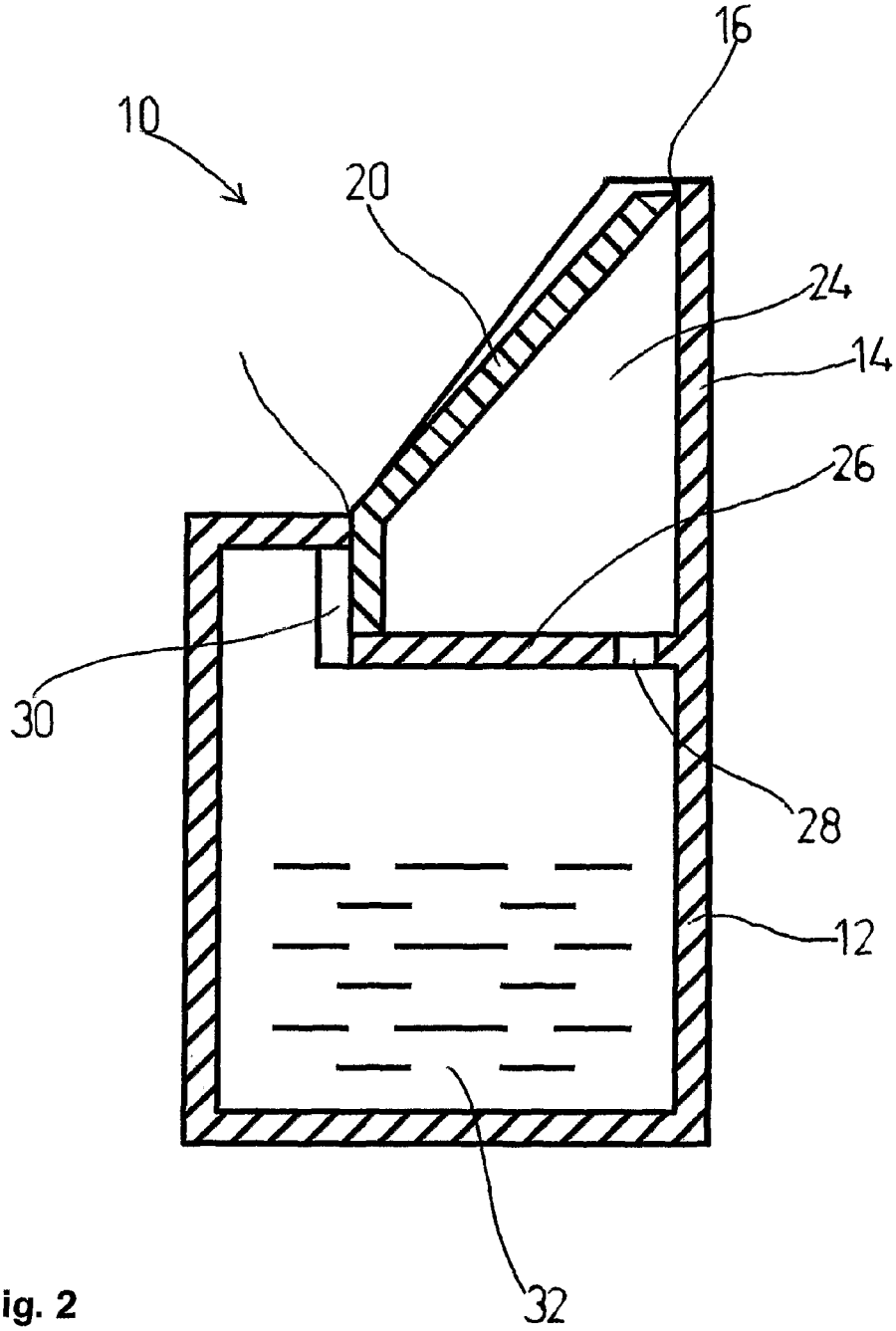

The arrangement of features of the valve arrangement 10 may be better appreciated in the cross-sectional side view of FIG. 2. Here the second chamber 32, which lies below the first chamber 24, and which is separated therefrom by the partition 26, can be seen. In this arrangement, it can be seen that the sealing member 20 normally seals the first chamber 24 from an exterior of the container 12, and additionally provides a seal across the second aperture 30 to provide a seal between the second chamber 32 and an exterior of the container 12.

Figure 3A:
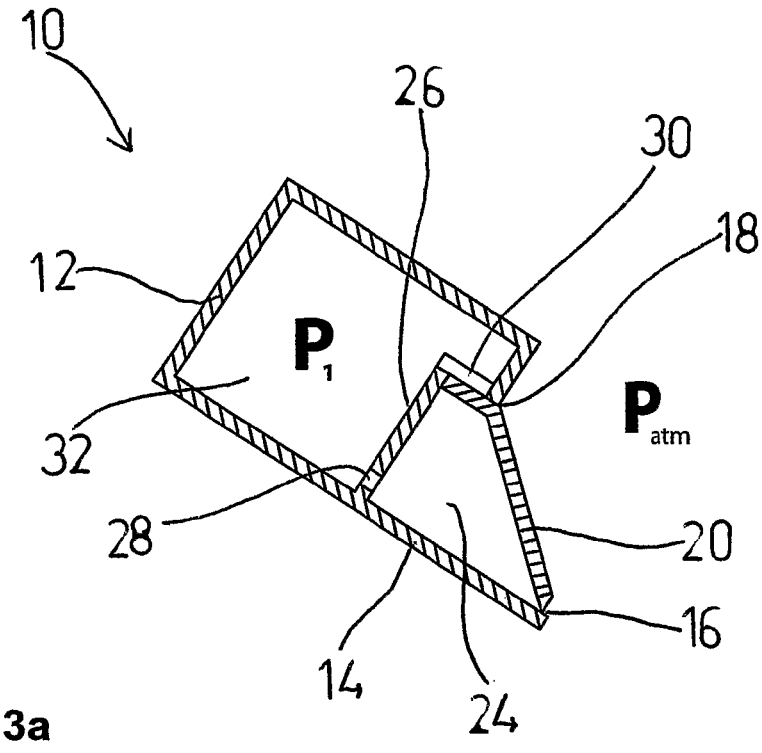
Figure 3B:
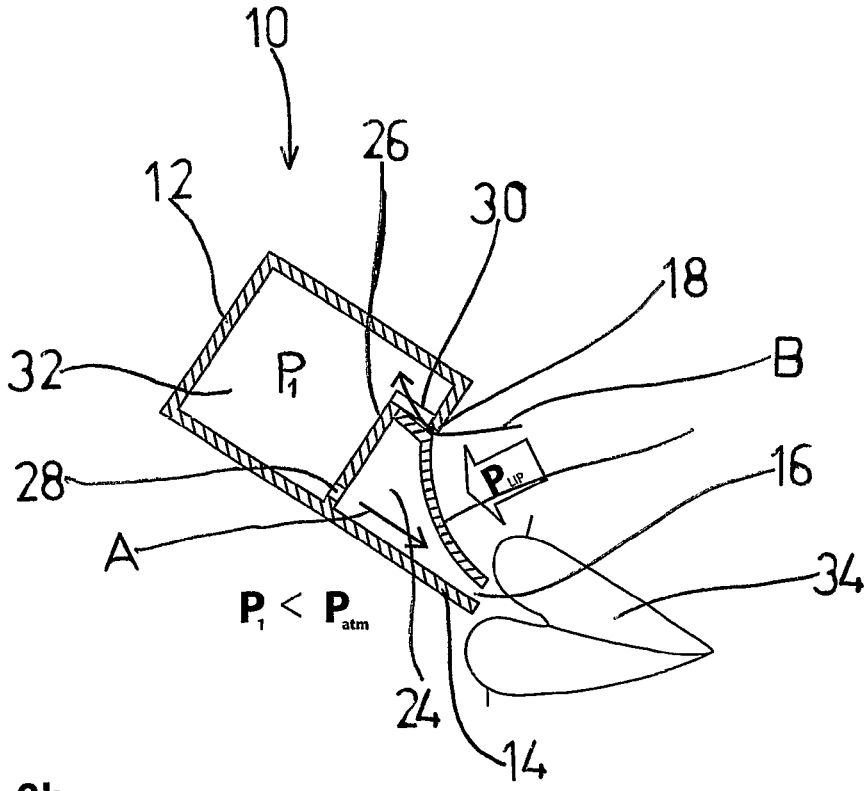

In FIGS. 3*a* and 3*b*, the container 12 and valve arrangement 10 are shown, having been tilted, to demonstrate operation of the valve arrangement. In FIG. 3*a*, the sealing member 20 is in an undeformed state such that edges thereof abut first and second valve seats 16, 18 to provide a seal across the second aperture 30 and between the first chamber and an exterior of the container 12. Thus, the pressure $P_1$ in the container 12 and the pressure, i.e. atmospheric pressure $P_{atm}$, outside the container 12 are equal, and any liquid located in the container 12, either in the second chamber 26, or in the first chamber 24, cannot pass via the sealing member 20 to the exterior of the container 12.

FIG. 3*b*, however, illustrates the case where a user is drinking from the container 12 and where the user's lips 34 apply pressure $P_{lip}$ to the sealing member 20 which results in a pressure differential which deforms the sealing member 20. This results in a lifting of a first sealing edge of the sealing member 20 from the first valve seat 16 which, in turn, results in liquid in the second chamber 32 passing through the first aperture 28, or liquid outlet aperture, into the first chamber 24, and on through a gap between the first sealing edge and first valve seat 16 into the user's mouth. The flow of liquid is denoted by arrow A.

It will be appreciated that the flow of liquid out from the second chamber 32, causes the pressure therein to drop. This drop in pressure causes a further deformation of the sealing member 20 such that a second sealing edge of the sealing member 20 lifts from the second valve seat 18. As the pressure in the second chamber 32 has dropped, there is a pressure differential between the second chamber 32 and pressure outside the container 12 such that $P_1 < P_{atm}$. Thus, in order to reach equilibrium of pressure, air will pass from the exterior of the container 12 to the second chamber 32 via second aperture 30, or air inlet aperture, to equalise pressures. Row of air is denoted by arrow B.

Thus, it is the user's sucking action which operates the valve arrangement 10, with the sealing member 20 being deformed such that liquid outflow and air inflow occur in the region of application of pressure by the user's lips 34.

As will be appreciated, when the user removes their lips 34 from the valve arrangement 10, the sealing member 20 will return to its original shape and flow of liquid from said valve arrangement 10 will halt.

Figure 4A:
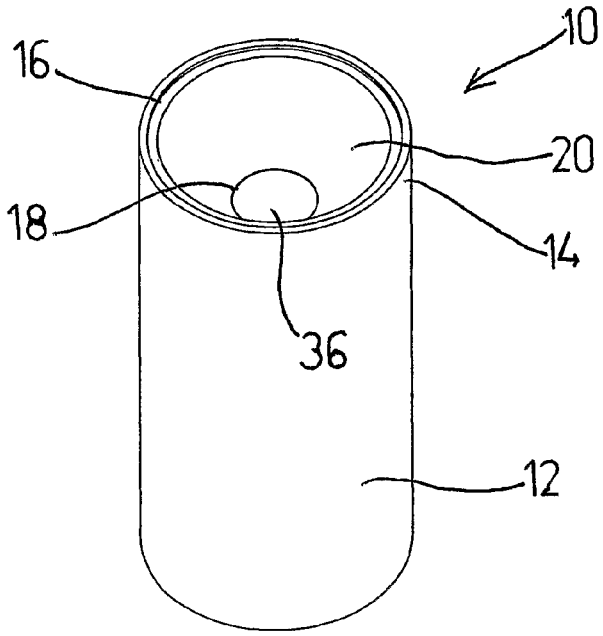
Figure 4B:
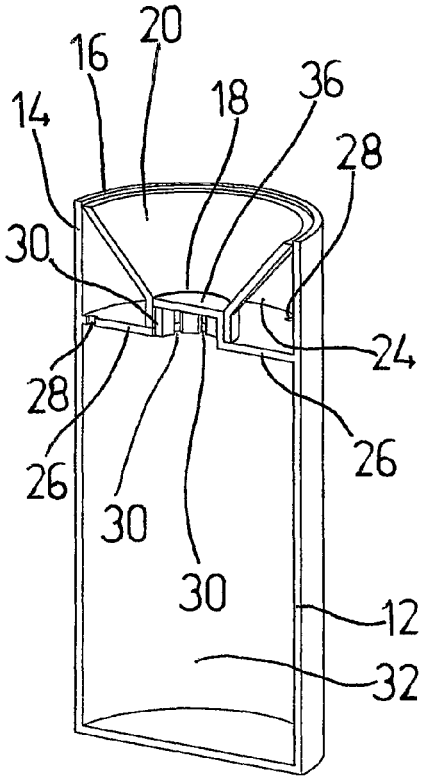
Figure 4C:
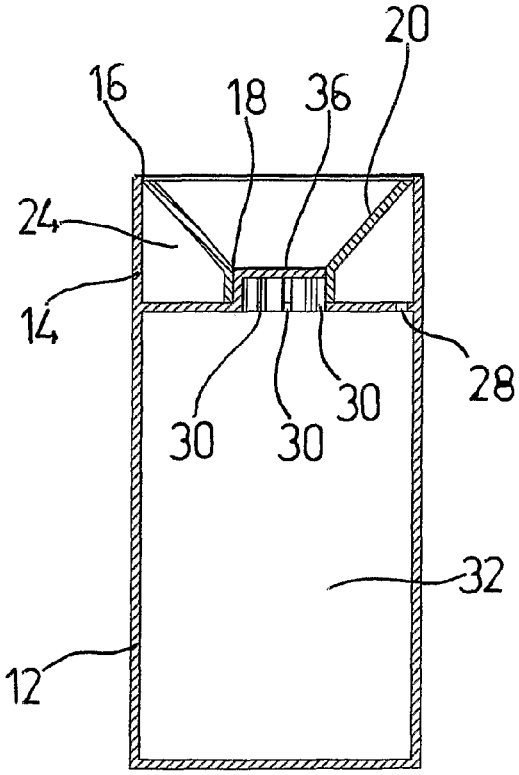

FIGS. 4*a* to 4*c* illustrate various views of a valve arrangement in a second embodiment. The valve arrangement of the second embodiment is similar to that of the first embodiment, and it is merely the shape of the valve arrangement and container which vary. Indeed, whilst the valve arrangement of the first embodiment relates to a linear valve arrangement, that of the second embodiment relates to a circular valve arrangement for a cylindrical container. Aside from these differences, the valve arrangement of the second embodiment operates in exactly the same manner as that of the first embodiment. Thus, features common to the first embodiment are denoted by like reference numerals and will not be described further.

In this second embodiment, there is provided a central retaining portion 36, part of which forms valve seat 18, and which is used to retain said sealing member 20 in position. In the illustrated embodiment, central retaining portion 36 forms part of partition 26 and is defined by an upstanding cylindrical portion of said partition 26. However, in an alternative arrangement, central retaining portion 36 may be a removable member configured to engage with engaging means in said partition 26 to attach the central retaining portion 36 to the partition 26.

The remaining embodiments of the present invention will now be described in relation to circular valve arrangements suitable for cylindrical containers. Of course, these could be easily adapted to fit other shaped containers and could also be adapted to form linear valve arrangements.

Figure 5:
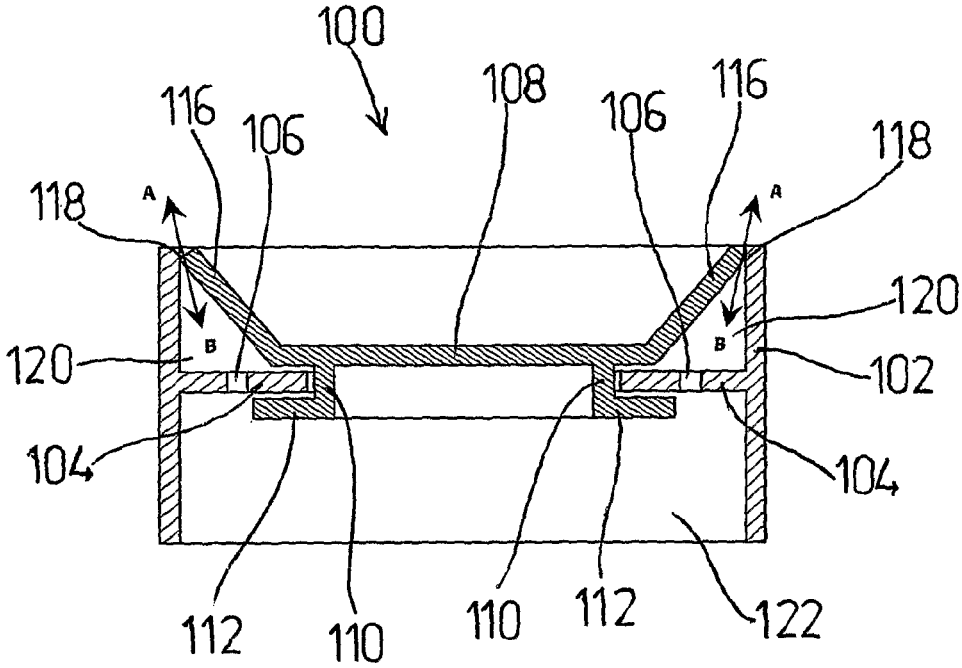
FIG. 5 illustrates a cross-sectional side view of a valve arrangement in a third embodiment of the present invention.

FIG. 5 illustrates a valve arrangement 100 comprising a substantially cylindrical supporting member 102. An annular flange 104 extends from an inner surface of the supporting member 102 and includes at least one aperture 106. The valve arrangement 100 includes substantially frusto-conical sealing member 108 which, when viewed in plan, is seen as a disc which is formed from a deformable material. Sealing member 108 is located to rest upon annular flange 104. The sealing member 108 includes a downwardly extending cylindrical section 110 which, at an end remote from the sealing member 108, comprises a retaining annular flange 112 which extends from said remote end. The cylindrical section 110 is located adjacent edges of said annular flange 104 remote from the inner surface of the supporting member 102 and said retaining annular flange 112 is located below the annular flange 104 and partly overlaps said annular flange. This overlap of the annular flange 104 and retaining flange 112 serves to retain the sealing member 108 in position in the supporting member 102.

An upstanding conical surface 116 of said sealing member 108 is arranged such that an edge remote from a central portion of said sealing member 108 normally rests against a valve seat portion 118 of the inner surface of the supporting member 102.

A first chamber 120 is formed above said annular flange 104 between said inner surface of said supporting member 102, an upper surface of said annular flange 104, and said upstanding conical surface of said sealing member 108.

A second chamber 122 is formed below said annular flange 104 between said inner surface of said supporting member 102, a lower surface of said annular flange 104, and a bottom surface (not shown) of said valve arrangement 100, or a container to which the valve arrangement 100 is fitted.

The at least one aperture 106 provides fluid communication between the first chamber 120 and second chamber 122.

In the embodiment illustrated in FIG. 5, the sealing member 108 is arranged to deform through the action of pressure applied by the lips of a user in the same manner as described in relation to FIG. 3*b*. During such deformation, liquid is arranged to pass from the second chamber to the first chamber via aperture 106, and from the first chamber 120 to the user's mouth via a gap formed between the remote edge of the upstanding conical surface 116 of the sealing member 108 and the valve seat 118. It will be appreciated that such a gap forms when the sealing member 108 is deformed. The flow of liquid is illustrated by arrow A in FIG. 5.

Air is arranged to enter the first chamber 120 via the same gap formed between the remote edge of the upstanding conical surface 116 of the sealing member 108 and the valve seat 118. Such flow of air is illustrated by arrow B in FIG. 5. The air is arranged to pass from the first chamber 120 to the second chamber 122 through the said at least one aperture 106.

Figure 6:
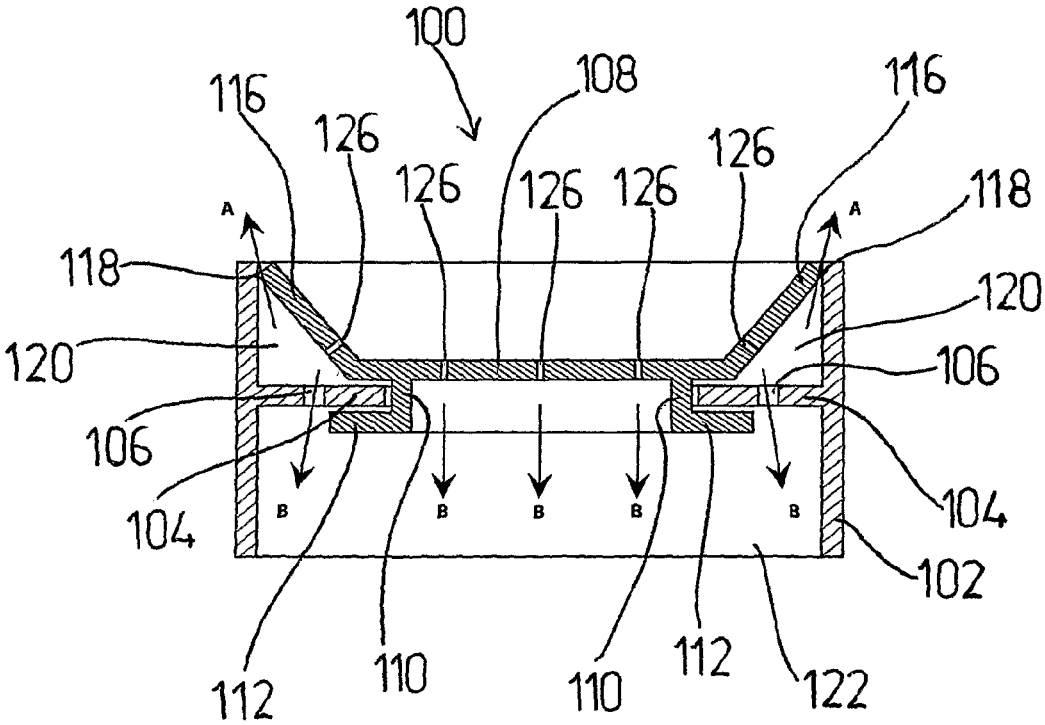
FIG. 6 illustrates a cross-sectional side view of a valve arrangement in a fourth embodiment of the present invention.

The embodiment of FIG. 6 comprises a modification to the embodiment of the present invention as illustrated in FIG. 5. Corresponding features are denoted by like reference numerals and will not be described further.

In the illustrated embodiment of FIG. 6, the sealing member 108 includes apertures 126, which may be slits, and which are arranged to allow air to pass through the sealing member 108, either directly into the second chamber 122, or into the first chamber 120 and on into the second chamber 122 via said at least one aperture 106.

When the sealing member 108 is in the undeformed state, the apertures 126 are closed. However, when the sealing member 108 is deformed, this causes the apertures 126 to open. Again, liquid flow is illustrated by arrows A and air flow is illustrated by arrows B.

The embodiment of FIGS. 7*a* and 7*b* comprises a modification to the embodiment of the present invention as illustrated in FIG. 5. Corresponding features are denoted by like reference numerals and will not be described further.

In the illustrated embodiment of FIGS. 7*a* and 7*b* the sealing member 108 includes a plurality of valve elements 128 which are arranged to allow air to pass through the sealing member 108, either directly into the second chamber 122, or into the first chamber 120 and on into the second chamber 122 via said at least one aperture 106.

The plurality of valve elements 128 comprise one-way valves which only allow passage of fluid, i.e. air, in one direction and which prevent liquid passing therethrough, for example, when the valve arrangement 100 is upturned. Again, liquid flow is illustrated by arrows A and air flow is illustrated by arrows B.

In an alternative arrangement of the embodiment illustrated in FIGS. 7*a* and 7*b*, at least one of the valve elements may be replaced by elements which comprise a breathing membrane which allows passage of air, but not liquid. A suitable material for the breathing membrane may comprise Goretex®. The breathing membrane is arranged to operate in the same way as the one-way valve described above.

The embodiments of FIGS. 8, 9 and 10 each comprise a modification to the embodiment of the present invention as illustrated in FIG. 5. Corresponding features are denoted by like reference numerals and will not be described further.

In the illustrated embodiment of FIG. 8, the sealing member 108 is formed entirely of a breathing membrane which allows passage of air, but not liquid, such as described in relation to the alternative arrangement of the embodiment illustrated in FIGS. 7*a* and 7*b*. A suitable material for the breathing membrane may comprise Goretex®. Again, liquid flow is illustrated by arrows A and air flow is illustrated by arrows B. As will be appreciated, in this embodiment, air can pass through the membrane of the sealing member 108 at any point, but liquid can only exit when a gap forms between the upstanding conical surface 116 and the valve seat.

In the illustrated embodiment of FIG. 9, a portion 130 of the sealing member 108 is formed from a breathing membrane which allows passage of air, but not liquid, and the remainder of the sealing member 108 is formed from any other suitable deformable material. Again, a suitable material for the breathing membrane may comprise Goretex®. Liquid flow is again illustrated by arrows A and air flow is illustrated by arrows B. As will be appreciated, in this embodiment, air can pass through the sealing member 108 at any point thereof formed from the breathing membrane, but liquid can only exit when a gap forms between the upstanding conical surface 116 and the valve seat.

The embodiment of FIG. 10 is similar to that of FIG. 9, but with a different portion 132 of the sealing member 108 being formed from the breathing membrane which allows passage of air, but not liquid and the remainder of the sealing member 108 being formed from the other suitable deformable material. Again, a suitable material for the breathing membrane may comprise Goretex®. Liquid flow is again illustrated by arrows A and air flow is illustrated by arrows B. As will be appreciated, in this embodiment, air can pass through the sealing member 108 at any point thereof formed from the breathing membrane, but liquid can only exit when a gap forms between the upstanding conical surface 116 and the valve seat.

FIG. 11 illustrates a valve arrangement 100 similar to that illustrated in FIG. 5, but with the substantially frusto-conical sealing member 108 in the form of a disc replaced with a substantially frusto-conical sealing member 134 in the form of an annulus.

The valve arrangement 100 of FIG. 11 comprises a substantially cylindrical supporting member 102. An annular flange 104 extends from an inner surface of the supporting member 102 and includes at least one aperture 106. The substantially frusto-conical sealing member 134 is formed from a deformable material, and is located to rest upon annular flange 104. As noted above, the sealing member 134, when viewed in plan, is seen as an annulus. The sealing member 134 includes a downwardly extending cylindrical section 110 which, at an end remote from the sealing member 134, comprises a retaining annular flange 112 which extends from said remote end. The cylindrical section 110 is located adjacent edges of said annular flange 104 remote from the inner surface of the supporting member 102 and said retaining annular flange 112 is located below the annular flange 104 and partly overlaps said annular flange 104. This overlap of the annular flange 104 and retaining flange 112 partly serves to retain the sealing member 134 in position in the supporting member 102.

The valve arrangement 100 further comprises a circular section 136 located below the annular flange 104 and spaced therefrom by spacing means 138. The circular section 136 is located below the retaining annular flange 112 and serves to retain the sealing member 134 in position in the supporting member 102.

An upstanding conical surface 116 of said sealing member 134 is arranged such that a remote edge thereof normally rests against a valve seat portion 118 of the inner surface of the supporting member 102.

A first chamber 120 is formed above said annular flange 104 between said inner surface of said supporting member 102, an upper surface of said annular flange 104, and said upstanding conical surface 116 of said sealing member 134.

A second chamber 122 is formed below said annular flange 104 between said inner surface of said supporting member 102, a lower surface of said annular flange 104, and a bottom surface (not shown) of said valve arrangement 100, or a container to which the valve arrangement 100 is fitted.

The at least one aperture 106 provides fluid communication between the first chamber 120 and second chamber 122.

In the embodiment illustrated in FIG. 11, the sealing member 134 is arranged to deform through the action of pressure applied by the lips of a user in the same manner as described in relation to FIG. 3*b*. During such deformation, liquid is arranged to pass from the second chamber 122 to the first chamber via aperture 106, and from the first chamber 120 to the user's mouth via a gap formed between the remote edge of the upstanding conical surface 116 of the sealing member 134 and the valve seat 118. It will be appreciated that such a gap forms when the sealing member 134 is deformed. The flow of liquid is illustrated by arrow A in FIG. 11.

Air is arranged to enter the first chamber 120 via the same gap formed between the remote edge of the upstanding conical surface 116 of the sealing member 134 and the valve seat 118. Such flow of air is illustrated by arrow B in FIG. 11. The air is arranged to pass from the first chamber 120 to the second chamber 122 through the said at least one aperture 106.

The embodiment of FIG. 12 comprises a modification to the embodiment of the present invention as illustrated in FIG. 11. Corresponding features are denoted by like reference numerals and will not be described further.

In the illustrated embodiment of FIG. 12, the sealing member 134 includes apertures 140, which may be slits, and which are arranged to allow air to pass through the sealing member 134, either directly into the second chamber 122 or, as illustrated, into the first chamber 120 and on into the second chamber 122 via said at least one aperture 106.

When the sealing member 134 is in the undeformed state, the apertures 140 are closed. However, when the sealing member 134 is deformed, this causes the apertures 140 to open. Again, liquid flow is illustrated by arrows A and air flow is illustrated by arrows B.

The embodiment of FIG. 13 comprises a modification to the embodiment of the present invention as illustrated in FIG. 11. Corresponding features are denoted by like reference numerals and will not be described further.

In the illustrated embodiment of FIG. 13, the sealing member 134 is formed entirely of a breathing membrane which allows passage of air, but not liquid. A suitable material for the breathing membrane may comprise Goretex®. Liquid flow is illustrated by arrows A and air flow is illustrated by arrows B. As will be appreciated, in this embodiment, air can pass through the membrane of the sealing member 134 at any point so as to flow from an exterior of the valve arrangement 100 to said first chamber 120, but liquid cannot pass in the opposite direction. Liquid can only exit via a gap formed between the upstanding conical surface 116 and the valve seat portion 118 when the sealing member 134 is deformed.

In the illustrated embodiment of FIG. 14, a portion 142 of the sealing member 134 is formed from a breathing membrane which allows passage of air, but not liquid and the remainder of the sealing member 134 is formed from any other suitable deformable material. Again, a suitable material for the breathing membrane may comprise Goretex®. Liquid flow is again illustrated by arrows A and air flow is illustrated by arrows B. As will be appreciated, in this embodiment, air can pass through the sealing member 134 at any point thereof formed from the breathing membrane.

The embodiment of FIG. 15 comprises yet another modification to the embodiment of the present invention as illustrated in FIG. 11. Corresponding features are denoted by like reference numerals and will not be described further.

In the illustrated embodiment of FIG. 15, at least one valve element 144 is located in said circular section 136 which is arranged to allow air to pass through the circular section 136 directly into the second chamber 122.

The at least one valve element 144 comprises a one-way valve which only allows passage of fluid, i.e. air, in one direction and which prevents liquid passing therethrough, for example, when the valve arrangement 100 is upturned. Again, liquid flow is illustrated by arrows A and air flow is illustrated by arrow B.

The embodiment of FIG. 16 comprises yet another modification to the embodiment of the present invention as illustrated in FIG. 11. Corresponding features are denoted by like reference numerals and will not be described further.

In the illustrated embodiment of FIG. 16, at least one breathing membrane element 146 is located in said circular section 136 which is arranged to allow air to pass through the circular section 136 directly into the second chamber 122.

The at least one breathing membrane element 146 acts as a one-way valve which only allows passage of fluid, i.e. air, in one direction and which prevents liquid passing therethrough, for example, when the valve arrangement 100 is upturned. Again, liquid flow is illustrated by arrows A and air flow is illustrated by arrow B. A suitable material for the breathing membrane may comprise Goretex®.

FIG. 17 illustrates an embodiment of the present invention, where the valve arrangement 100 as embodied in FIG. 11 is fitted to a vessel 148 suitable for holding a liquid, such as a drink.

In a first arrangement of this embodiment, a valve element, such as those described above, may be located at a position indicated by reference C in FIG. 17, i.e. between a top edge, or rim, of the liquid vessel 148 and the valve arrangement 100.

In a second arrangement of this embodiment, which may be an alternative arrangement to the first arrangement described above, or in addition to the first arrangement, a valve element may be located at a position indicated by reference D in FIG. 17, i.e. in a side wall of the liquid vessel 148.

In a third arrangement of this embodiment, which may be an alternative arrangement to the first and second arrangements described above, or in addition to the first and/or second arrangements, a valve element may be located at a position indicated by reference E in FIG. 17, i.e. in a base of the liquid vessel 148.

In a fourth arrangement of this embodiment, which may be an alternative arrangement to the first, second and third arrangements described above, or in addition to the first, second and/or third arrangements, a breathing membrane element, such as those described above, may be located at least one of the positions indicated by references C, D and E in FIG. 17, i.e. between a top edge of the liquid vessel 148 and the valve arrangement 100, or in a side wall or base of the liquid vessel 148.

FIG. 18 illustrates an embodiment of the present invention where the valve arrangement 100 as embodied in FIG. 11 is adapted to be fitted to a vessel 150 suitable for holding liquids, such as a glass, mug, etc.

An secondary annular seal 152 is fitted to said circular section 136 to be coaxial therewith. The secondary annular seal 152 is arranged to provide a push-fit type engagement of the valve arrangement 100 to the liquid vessel 150.

At least one air channel 154 is formed through said circular section with one end thereof opening into said vessel 150, i.e. below said secondary annular seal 152, and an opposite end opening to a position above the secondary annular seal 152. At least one liquid channel 156 is formed through said circular section with one end thereof opening into said vessel 150, i.e. below said secondary annular seal 152, and an opposite end opening to a position above the secondary annular seal 152. Such at least one air channel 154 allows air to pass from said valve arrangement 100 and into the vessel 150. The at least one liquid channel 156 allows liquid to pass from the vessel 150 to the valve arrangement 100.

FIG. 19 illustrates an embodiment of the present invention where the valve arrangement 100 of FIG. 11 is fitted to a liquid vessel 150 by way of a push-fit arrangement. The push-fit arrangement may employ adjustable rings, or pressurised flanges to allow the valve arrangement 100 to be fitted to different sized vessels.

FIG. 20 illustrates a further embodiment which modifies that of FIG. 19, and in which the valve arrangement 100 further comprises a stand 158 to prevent the valve arrangement 100 being inserted too far into the vessel 150, i.e. to such an extent that it cannot be easily removed from the vessel.

The stand 158 comprises an elongate member extending downwards from the circular section 136, and which serves to space the valve arrangement 100 from the base of the vessel 150.

FIG. 21 illustrates another embodiment which modifies that of FIG. 20, and in which the valve arrangement 100 further comprises a hook 160 to assist a user in removing the valve arrangement from the vessel 150. The hook 160 is arranged to upstand from an upper surface of said circular section 136, and is shaped to allow a user to insert a finger therethrough to grip said hook 160.

Although the embodiment illustrated in FIG. 21 shows the stand 158 and hook 160 in combination, the hook 160 could be provided on a valve arrangement without the stand 158.

The valve arrangement 100 of FIG. 22 comprises a modification to that illustrated in FIG. 11. In this embodiment, the circular section 136 is formed with an aperture.

A substantially cylindrical light unit 162 is located in said aperture of said circular section 136 and upstands therefrom through said sealing member 134. An upwardly facing surface of said light unit 162 has located thereon a solar panel 164.

The light unit 162 is formed from a liquid-proof material to prevent liquid entering said light unit 162.

In this embodiment, the valve arrangement 100 is formed from a transparent or translucent material to allow light from said light unit 162 to pass through the walls of the valve arrangement 100 to be visible at the exterior thereof.

Providing a light unit in the valve arrangement which is operable to emit light when darkness falls, can assist a person trying to locate a vessel, to which the valve arrangement is mounted, in the dark, e.g. where a person tries to locate the vessel on a bedside table at night.

The light unit 162 may include a switch to control operation of the light, or a light sensor arranged to actuate the light unit when darkness falls. The light unit includes a rechargeable battery arranged to power the light unit 162 and coupled to the solar panel 164 which allows the rechargeable battery to be recharged.

The valve arrangement 100 of FIGS. 23*a* and 23*b* comprises a modification to that illustrated in FIG. 11. In this embodiment, the circular section 136 is formed with at least one liquid refill aperture 166 which extends through said circular section 136.

A flexible member 168, preferably a disc, is located beneath said circular section 136 and is located to cover said at least one refill aperture 166. The flexible member 168 can be deformed to uncover said at least one refill aperture 166 such that a fluid path therethrough is revealed that runs from a top surface of the circular section 136 to a lower surface of the circular section 136. The flexible member 168 is illustrated in an undeformed state in FIG. 23*a* and in a deformed state in FIG. 23*b*.

The valve arrangement 100 of this embodiment provides a means by which a vessel to which the valve arrangement 100 is attached can be filled without removing the valve arrangement 100 from the vessel.

The flexible disc 168 operates on the principle of a pressure deformable valve. As liquid is poured the frusto-conical sealing member 134, due to the shape of the sealing member 134, the liquid will run towards the centre of the sealing member 134 and down to the circular section 136. Upon reaching the circular section 136, the liquid will begin to pool, and liquid will also pool in the at least one liquid refill aperture 166. As more liquid pools, the weight of the pooled liquid will increase and, eventually, the weight of the pooled liquid exerting a downward force on the flexible member 168 will be sufficient to deform the flexible member 168, and the liquid will then pass into the vessel.

When a user drinks from the vessel, liquid will not be able to pass through the at least one liquid refill aperture 166 since the flexible member 168 covers the liquid refill aperture 166. Of course, the flexible member 168 is prevented from deforming in the upward direction since it is pressed flat against the circular section 136.

This arrangement could also be implemented through use of a ball valve.

FIGS. 24*a* and 24*b* illustrates yet another embodiment which modifies the embodiment illustrated in FIG. 11.

In this embodiment, there is provided a locking mechanism 170 which comprises a circular element 172 and cylindrical section 174 depending therefrom. The cylindrical section 174 is arranged for location such that it extends down through centre of the annular frusto-conical sealing member 134 and so that the end of the cylindrical section 174 is adjacent the circular section 136.

The locking mechanism 170 is movable between an unlocked position as illustrated in FIG. 24*a* and a locked position as illustrated in FIG. 24*b*.

The locking mechanism 170 serves to allow the seal to be sealed to a greater extent. The sealing member on its own is strong enough to retain liquid within a vessel to which the valve arrangement 100 is attached, but weak enough to be deformed by suction to allow a user to draw liquid from the vessel via the valve arrangement 100.

When the locking mechanism 170 is located in the locked position, the edges of the circular element 172 trap the sealing member 134 against the valve seat 118 such that the sealing member 134 cannot be deformed therefrom and thus liquid cannot pass through the valve arrangement 100. This can prevent liquid being lost when, for example, the vessel is placed in a bag or when the vessel is vigorously shaken.

The locking element 170 can be moved between locked and unlocked positions by, for example, a screwing motion, or a push-pull motion.

It should be appreciated that a valve arrangement according to the present invention can incorporate any combination of features described above and is not limited to the embodiments as specifically described.

The invention claimed is:

1. A valve arrangement for location on a vessel for holding liquids, comprising:

a supporting member configured to form a valve seat;

a deformable sealing member located against said valve seat and arranged for deformation under an applied pressure to present a first gap between said sealing member and said valve seat in a region where pressure is applied to allow a liquid to be dispensed from the vessel via said valve arrangement, and a second gap between said sealing member and a valve seat in a region where pressure is applied, to allow air to enter said valve arrangement;

a retaining member arranged to retain said deformable sealing member against said supporting member to a sufficient extent such that said deformable sealing member is held relative to said supporting member, but is free to deform to allow said first and second gaps to be presented when said deformable sealing member is deformed;

wherein said supporting member, deformable sealing member and retaining member define therebetween a chamber, with said chamber being arranged for fluid communication with a vessel to which said valve arrangement is attached by at least one first aperture formed in said retaining member; and a filling valve located in said sealing member and arranged to provide fluid communication with said chamber to allow a user to add liquid to said chamber in a first direction during a filling operation but to prevent liquid passing in a second opposite direction.

2. The valve arrangement of claim 1, wherein said at least one first aperture comprises an outlet aperture arranged to allow flow of liquid from said vessel to which said valve arrangement is attached to said chamber.

3. The valve arrangement of claim 1, wherein said retaining member is formed with at least one second aperture therein to provide fluid communication between a vessel to which said valve arrangement is attached and an exterior of said valve arrangement, said at least one second aperture being covered by said sealing member when in an undeformed state, and said at least one second aperture being revealed when said second gap between said sealing member and said valve seat is formed.

4. The valve arrangement of claim 3, wherein at least one second aperture comprises an inlet aperture arranged to allow flow of air from said exterior to said vessel to which said valve arrangement is attached.

5. The valve arrangement of claim 1, wherein said valve arrangement comprises a linear arrangement and said sealing member comprises a planar sheet.

6. The valve arrangement of claim 1, wherein said valve arrangement comprises a cylindrical arrangement and said sealing member comprises an annular member.

7. The valve arrangement of claim 1, wherein said valve arrangement comprises a cylindrical arrangement and said sealing member comprises a disc.

8. The valve arrangement of claim 1, wherein said supporting member comprises means for attaching said valve arrangement to a vessel.

9. The valve arrangement of claim 1, further comprising an element for preventing said valve arrangement being inserted too far into a vessel.

10. The valve arrangement of claim 1, further comprising a member for allowing a user to more conveniently grip said valve arrangement for removal of said valve arrangement from a vessel to which it is attached.

11. The valve arrangement of claim 1, wherein said valve arrangement is provided with a light unit operable to emit light when an ambient light level falls below a predetermined level.

12. The valve arrangement of claim 11, further comprising a solar panel with a surface thereof arranged to be upfacing in a normal orientation of said valve arrangement, said solar panel being coupled to a rechargeable power source located within said light unit for providing power to said light unit, and said solar panel being arranged to recharge said rechargeable power source.

13. The valve arrangement of claim 1, wherein said filling valve comprises a pressure deformable valve arranged to deform to reveal filling apertures providing fluid communication with said chamber when a liquid is poured into said filling valve during a filling operation.

14. The valve arrangement of claim 1, further comprising a locking mechanism movable between a first position in which said locking mechanism serves to prevent deformation of said deformable sealing member, and a second position which allows said deformable sealing member to be deformed under application of pressure.

15. The valve arrangement of claim 1, further including a vessel for holding liquids comprising a liquid containing receptacle, said receptacle having an open end and said valve arrangement mounted on said open end.

16. The valve arrangement of claim 15, further comprising at least one air inlet aperture located in a wall and/or base of said receptacle, and/or at a rim of said receptacle, with a fluid control member located in said air inlet aperture.

17. The valve arrangement of claim 16, wherein said fluid control member comprises a one-way valve arranged to allow flow of air into said receptacle and prevent flow of liquid out of said receptacle.

18. The valve arrangement of claim 16, wherein said fluid control member comprises a breathing membrane arranged to allow flow of air into said receptacle and prevent flow of liquid out of said receptacle.

19. The valve arrangement of claim 15, wherein said valve arrangement is attached to said receptacle by way of a push-fit sealing element.

20. The valve arrangement of claim 15, wherein said valve arrangement is integral with said receptacle.

21. A valve arrangement for location on a vessel for holding liquids, comprising:

a supporting member configured to form a valve seat;

a deformable sealing member located against said valve seat and arranged for deformation under an applied pressure to present a gap between said sealing member and said valve seat in a region where pressure is applied to allow a liquid to be dispensed from the vessel via said valve arrangement;

an air inlet element arranged to allow air to enter said valve arrangement;

a retaining member arranged to retain said deformable sealing member against said supporting member to a sufficient extent such that said deformable sealing member is held relative to said supporting member, but is free to deform to allow said gap to be presented when said deformable sealing member is deformed; wherein said supporting member, deformable sealing member and retaining member define therebetween a chamber, with said chamber being arranged for fluid communication with a vessel to which said valve arrangement is attached by at least one first aperture formed in said retaining member; and a filling valve located in said sealing member and arranged to provide fluid communication with said chamber to allow a user to add liquid to said chamber in a first direction during a filling operation but to prevent liquid passing in a second opposite direction.

22. The valve arrangement of claim 21, wherein said retaining member is integral with said deformable sealing member.

23. The valve arrangement of claim 21, wherein said air inlet element is located in said deformable sealing member.

24. The valve arrangement of claim 21, wherein said air inlet element comprises at least one aperture.

25. The valve arrangement of claim 24 wherein a one-way valve arranged to allow flow of air therethrough in a first direction and prevent flow of liquid therethrough in a second, opposite direction, is located in said at least one aperture.

26. The valve arrangement of claim 24, wherein a breathing membrane arranged to allow flow of air therethrough in a first direction and prevent flow of liquid therethrough in a second, opposite direction, therethrough is located in said at least one aperture.

27. The valve arrangement of claim 21, wherein said air inlet element comprises at least a portion of said sealing member formed from a breathing membrane, said breathing membrane arranged to allow flow of air therethrough in a first direction and prevent flow of liquid therethrough in a second, opposite direction.

28. The valve arrangement of claim 21, wherein said supporting member defines an upstanding spout.

29. The valve arrangement of claim 21, wherein said valve arrangement comprises a cylindrical arrangement and said sealing member comprises a disc.

30. The valve arrangement of claim 21, wherein said valve arrangement comprises a cylindrical arrangement and said sealing member comprises an annular member.

31. The valve arrangement of claim 21, wherein said supporting member comprises means for attaching said valve arrangement to a vessel.

32. The valve arrangement of claim 31, further comprising an element for preventing said valve arrangement from being inserted too far into said vessel.

33. The valve arrangement of claim 21, wherein said filling valve comprises a pressure deformable valve arranged to deform to reveal filling apertures providing fluid communication with said chamber when a liquid is poured into said filling valve during a filling operation.

* * * * *